US009815105B2

(12) United States Patent
Johnston et al.

(10) Patent No.: US 9,815,105 B2
(45) Date of Patent: Nov. 14, 2017

(54) PUNCH HOLDER AND PUNCH CONFIGURATIONS

(71) Applicant: WILSON TOOL INTERNATIONAL INC., White Bear Lake, MN (US)

(72) Inventors: Kevin A. Johnston, Deer Park, WI (US); John Morehead, New Richmond, WI (US)

(73) Assignee: Wilson Tool International Inc., White Bear Lake, MN (US)

( * ) Notice: Subject to any disclaimer, the term of this patent is extended or adjusted under 35 U.S.C. 154(b) by 216 days.

(21) Appl. No.: 13/899,399

(22) Filed: May 21, 2013

(65) Prior Publication Data

US 2014/0345435 A1 Nov. 27, 2014

(51) Int. Cl.

| | |
|---|---|
| ***B26F 1/14*** | (2006.01) |
| ***B21D 37/04*** | (2006.01) |
| ***B21D 28/34*** | (2006.01) |

(52) U.S. Cl.

CPC ..... *B21D 37/04* (2013.01); *B21D 28/346* (2013.01); *B26F 1/14* (2013.01); *Y10T 29/4973* (2015.01); *Y10T 83/9476* (2015.04); *Y10T 279/17717* (2015.01)

(58) Field of Classification Search

CPC . B21D 37/04; B21D 28/34; B26F 1/02; B26F 1/14; Y10T 83/9428; Y10T 279/17717; Y10T 83/9476; Y10T 29/4973

USPC ..... 83/699.21, 525, 527

See application file for complete search history.

(56) References Cited

U.S. PATENT DOCUMENTS

| | | | | |
|---|---|---|---|---|
| 4,273,015 | A | 6/1981 | Johnson | |
| 4,824,298 | A | 4/1989 | Lippacher et al. | |
| 4,989,484 | A | 2/1991 | Johnson et al. | |
| 5,017,157 | A | 5/1991 | Liu et al. | |
| 5,020,407 | A * | 6/1991 | Brinlee | 83/530 |
| 5,054,347 | A | 10/1991 | Johnson et al. | |
| 5,056,392 | A | 10/1991 | Johnson et al. | |
| 5,131,303 | A * | 7/1992 | Wilson | B21D 28/34 83/140 |
| 5,316,323 | A | 5/1994 | Jovanovic | |
| 5,752,424 | A | 5/1998 | Rosene et al. | |
| 5,839,341 | A | 11/1998 | Johnson et al. | |

(Continued)

FOREIGN PATENT DOCUMENTS

| | | |
|---|---|---|
| DE | 19505754 C1 | 5/1996 |
| FR | 2012207 A5 | 3/1970 |

OTHER PUBLICATIONS

ISR and Written Opinion corresponding to PCT Application PCT/US2014/038704, mailed Feb. 20, 2015, 17 pages.

*Primary Examiner* — Kenneth E. Peterson
*Assistant Examiner* — Nhat Chieu Do
(74) *Attorney, Agent, or Firm* — Fredrikson & Byron, P.A.

(57) ABSTRACT

Punch holders and corresponding punch configurations configured to increase the ease and speed by which maintenance and/or modification of punches used with the holders can be performed. In some cases, the punch holder can be configured with one or more upper and lower collars operatively situated on differing areas of the holder, with each collar adapted to perform a different action with regard to a punch held by the holder. In some cases, when the upper collar is rotated, a corresponding height adjustment of a punch held by the holder results. In some cases, when the lower collar is rotated, a punch held by the holder is released.

22 Claims, 12 Drawing Sheets

(56) References Cited

U.S. PATENT DOCUMENTS

| | | | | |
|---|---|---|---|---|
| 5,884,546 | A | 3/1999 | Johnson et al. | |
| 6,082,516 | A * | 7/2000 | Willer | 192/223.2 |
| 6,276,247 | B1 | 8/2001 | Helda | |
| 6,782,787 | B2 | 8/2004 | Morehead et al. | |
| 6,895,797 | B2 | 5/2005 | Lowry et al. | |
| 7,007,582 | B2 | 3/2006 | Iwamoto et al. | |
| 7,156,009 | B2 | 1/2007 | Iwamoto et al. | |
| 7,726,554 | B2 | 6/2010 | Thielges et al. | |
| 7,874,127 | B2 * | 1/2011 | Brown | 53/317 |
| 7,926,399 | B2 | 4/2011 | Huang et al. | |
| 7,975,587 | B2 | 7/2011 | Schneider | |
| 2007/0180723 | A1 | 8/2007 | Morgan | |
| 2007/0193323 | A1 | 8/2007 | Coelho et al. | |
| 2008/0314220 | A1 | 12/2008 | Ferry et al. | |
| 2009/0223032 | A1 * | 9/2009 | Huang | B21D 28/005 29/525.01 |
| 2009/0266209 | A1 | 10/2009 | Thielges et al. | |
| 2010/0132530 | A1 | 6/2010 | Chen | |
| 2011/0203417 | A1 | 8/2011 | Hill, III | |
| 2013/0118331 | A1 * | 5/2013 | Morehead et al. | 83/686 |
| 2013/0288743 | A1 | 10/2013 | Hunt et al. | |
| 2013/0319200 | A1 | 12/2013 | Johnston et al. | |

* cited by examiner 70
76
72
92
74
4C
4D
78a
78b
78c
78d
79a
79c
80
82a
82b
84
86
88
88a
90
94
96
98
100
102
104
105
106
108
110
111
112
114
115
118
122
124
126
128
130
132
134
136
138

170
172
176
192
173
174
50
8C
D
169
184
171
215
237
212
8D
8E
8F
8G
181
230
228
239
211
232
52
178a
182a
179a
179a'
178d
182c
179c
208
178c
179b
182b
172
192a
238
236
240
174
186
188
188a
190
216
220
218
214
224
228
187b
187a
180
150
226
234
178b
178a
182b
182a 172
176
192
170
173
174
50'
9C
8D
8E
8F
8G
171
181
228
239
211
232
156
154
152
150
215
237
224
178a
178b
178c
178d
179b
182a
182b
182c
186
187a
187b
188
188a
190
180
214
222
212
234

PUNCH HOLDER AND PUNCH CONFIGURATIONS

FIELD OF THE INVENTION

The present invention generally pertains to punch assemblies used in punch presses, and more particularly to punch holder and punch configurations of such assemblies.

BACKGROUND

Punch presses are typically configured to hold a plurality of tools for forming a variety of shapes and sizes of indentations and/or holes in sheet workpieces, for example, sheet metal. Tools of this sort commonly include at least one punch assembly and corresponding die. For example, in a multiple station turret punch press, a rotatable turret includes a plurality of bores, which hold a corresponding plurality of punch assemblies above a workpiece support surface, and a corresponding plurality of die receiving frames are located below the workpiece support surface. Alternatively, in other presses (such as Trumpf style presses), a rail (instead of a turret) is used for holding the punch assemblies.

A conventional punch assembly typically includes a punch guide, a punch body or holder, and a punch. The punch may be either fixedly or releasably attached to the holder. The punch holder and punch are often slidably engaged within the punch guide for reciprocal, axial movement along a central longitudinal axis of the punch guide. When such a punch assembly, and a corresponding die, are mounted in a press and located in a working position of the press, beneath the ram (or integrally connected to the ram), the punch is driven out from the punch guide, through an opening in a stripper plate, in order to form an indentation or a hole through a sheet workpiece with the tip of the punch. The stripper plate, which is attached to an end of the punch guide, prevents the workpiece from following the punch, upon its retraction back into the punch guide.

Those skilled in the art appreciate that the punches used in punch assemblies require regular maintenance and modification. For example, the punches may need to be sharpened or replaced when becoming worn, may need to be replaced when a different punch shape (or footprint) is required, and/or may need to be adjusted in position within the assembly to account for different lengths thereof. A variety of punch assembly configurations, which facilitate these types of maintenance and modification, have been taught and, in some cases, commercialized; however, there remains a need for new punch assembly configurations and methods that increase the ease and the speed by which such maintenance/modification can be made.

SUMMARY OF THE INVENTION

In certain embodiments of the invention, a punch holder is provided. The punch holder comprises an upper portion, a lower portion, a first collar, and a second collar. The upper portion comprises head unit for the punch holder and the lower portion comprises punch coupling unit for the punch holder. The upper portion is operably coupled yet selectively adjustable relative to the lower portion. The first collar encircles a lateral extent of the upper portion. The first collar is movable in position relative to the lower portion, whereby movement of the first collar provides a corresponding adjustment in overall height of the punch holder. The second collar encircles a lateral extent of the lower portion. The second collar is movable in position relative to the lower portion, whereby movement of the second collar corresponds to a shift from a locked configuration to an unlocked configuration for the lower portion relative to a punch held thereby.

Additionally, in certain embodiments of the invention, a punch holder is provided. The punch holder comprises an upper portion, a lower portion, and a collar. The upper portion comprises head unit for the punch holder and the lower portion comprises punch coupling unit for the punch holder. The upper portion is operably coupled to the lower portion. The collar encircles a lateral extent of the lower portion. The collar is movable in position relative to the lower portion, whereby movement of the collar corresponds to a shift from a locked configuration to an unlocked configuration for the lower portion relative to a punch held thereby. The collar is operably held about a protruding end of the lower portion. The collar is movable solely via rotation.

Also, in certain embodiments of the invention, a punch holder is provided. The punch holder comprises an upper portion, a lower portion, and a collar. The upper portion comprises head unit for the punch holder and the lower portion comprises punch coupling unit for the punch holder. The upper portion is operably coupled yet selectively adjustable relative to the lower portion. The collar encircles a lateral extent of the upper portion. The collar is movable in position relative to the lower portion, whereby movement of the collar provides a corresponding adjustment in overall height of the punch holder. The collar is operably coupled to the upper portion, wherein movement of the collar results in corresponding movement of the upper portion. The collar is movable solely via rotation.

Further, in certain embodiments of the invention, a method of releasing and replacing a punch within a punch holder is provided. The method comprises providing a punch holder. The punch holder comprises an upper portion, a lower portion, and a collar. The upper portion comprises head unit for the punch holder and the lower portion comprises punch coupling unit for the punch holder. The upper portion is operably coupled to the lower portion. The collar encircles a lateral extent of the lower portion. The collar is movable in position relative to the lower portion. The method comprises moving the collar by applying a force on the collar, whereby the movement of the collar corresponds to the lower portion shifting from a locked configuration to an unlocked configuration relative to a punch held by the lower portion. The method comprises moving further punch into contact with the lower portion. The contact between the further punch and the lower portion involves a force being applied on the lower portion, whereby the movement of the further punch corresponds to the lower portion shifting from the unlocked configuration to the locked configuration relative to the further punch.

DESCRIPTION OF THE DRAWINGS

The following drawings are illustrative of particular embodiments of the present invention and therefore do not limit the scope of the invention. The drawings should not be presumed as being to scale (unless so stated) and are intended for use in conjunction with the explanations in the following detailed description. Embodiments of the present invention will hereinafter be described in conjunction with the appended drawings, wherein like numerals denote like elements.

DETAILED DESCRIPTION

Figure 1C:
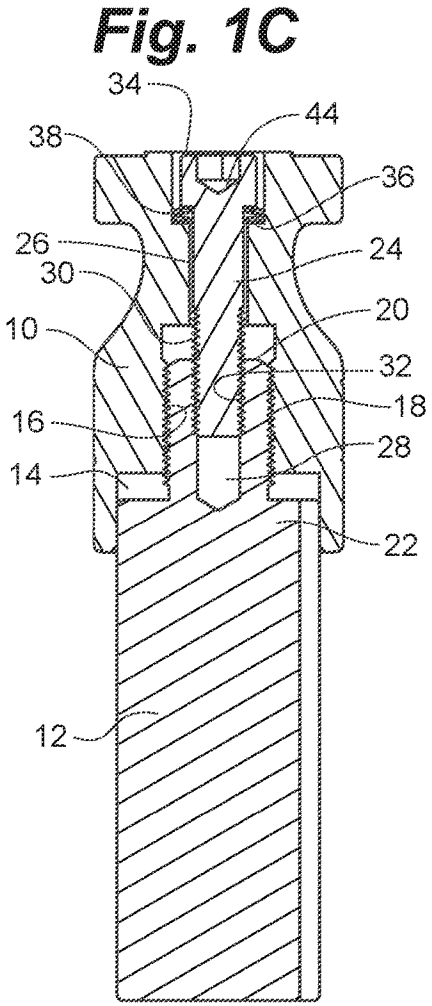
FIGS. 1A, 1B, and 1C are elevation, perspective, and cross-sectional views, respectively, of a punch holder and a punch relating to certain embodiments of the invention.

The following detailed description should be read with reference to the drawings, in which like elements in different drawings are numbered identically. The drawings depict selected embodiments and are not intended to limit the scope of the invention. It will be understood that embodiments shown in the drawings and described below are merely for illustrative purposes, and are not intended to limit the scope of the invention as defined in the claims.

As described above, a conventional punch assembly includes a punch guide, a punch body or holder, and a punch, wherein the punch can be either fixedly or releasably attached to the punch holder. As will be appreciated from the following description, certain embodiments described herein focus on punch holders and corresponding punch configurations. Among its many objects, the punch holders embodied herein are configured to increase the ease and speed by which maintenance and/or modification of punches used with the holders can be performed. Another exemplary object is to provide different configurations of punch holders so as to be applicable with a wide variety of punch press designs. A further object is to provide a tiered plurality of punch holders, each having a unique set of favorable characteristics. While this description and the corresponding drawings primarily pertain to punch holders and punches, it should be appreciated that the holders can be used with corresponding punch guides; however, the invention should not be limited to such.

Figure 1B:
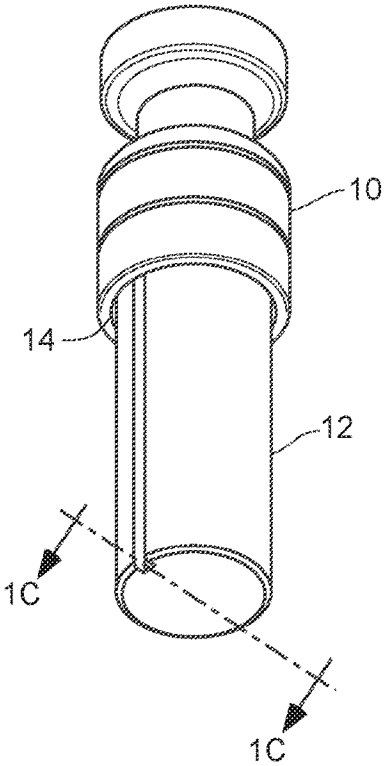
Figure 1A:
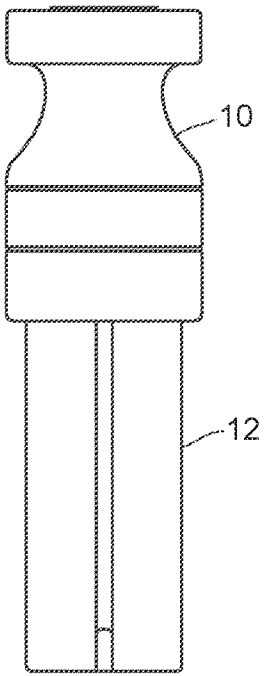

FIGS. 1A, 1B, and 1C, as described above, illustrate differing views of a punch holder 10 and a punch 12 relating to certain embodiments of the invention, with FIG. 1C showing a cross-sectional view of FIG. 1B along the lines 1C-1C. As shown, a lower end of the punch holder 10 defines a recess 14 in which the punch 12 is configured to be inserted and secured, and then subsequently locked. In particular, as illustrated in FIG. 1C, the recess 14 of the punch holder 10 has inner threading 16 configured to mate with outer threading 18 of a stem 20 of coupling end 22 of the punch 12. In use, the coupling end 22 of the punch 12 is inserted in the holder recess 14 such that the stem 20 is brought into contact with, and screwed into, the threading 16 of the holder recess 14. Upon reaching a desirable height for portion of the punch 12 extending out of the punch holder 10, the punch's position can then be locked. With continued reference to FIG. 1C, a fastener 24 (e.g., bolt) is inserted in a channel 26 that passes centrally through the punch holder 10. The fastener 24 is of a length so as to extend through the channel 26 and further into an inner bore 28 defined in the punch stem 20. In particular, the fastener 24 has outer threading 30 configured to mate with inner threading 32 of the punch bore 28. In use, when the fastener 24 is screwed inward such that its head 34 makes contact with a shoulder 36 within channel 26 (or upon fully depressing a spring 38 supported by the shoulder 36), the punch's position is locked relative to the holder 10.

Figure 2C:
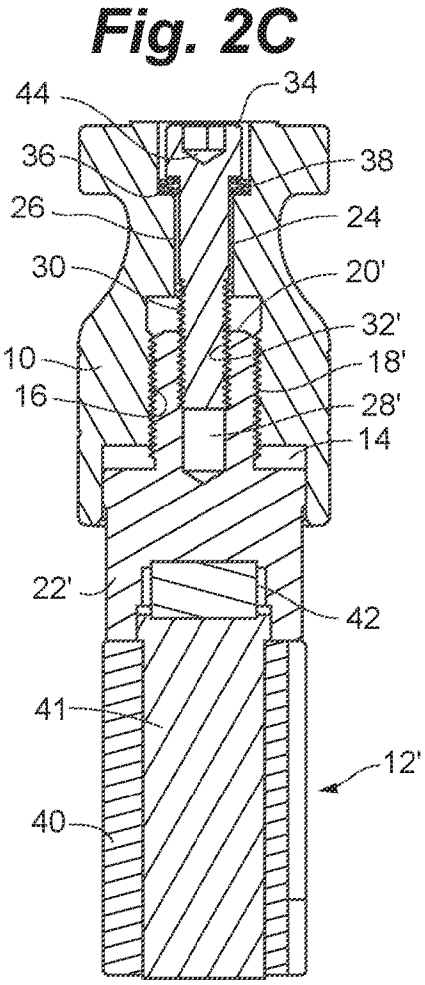
FIGS. 2A, 2B, and 2C are elevation, perspective, and cross-sectional views, respectively, of the punch holder of FIGS. 1A-1C and an alternate version of the punch of FIGS. 1A-1C further relating to certain embodiments of the invention.
Figure 2B:
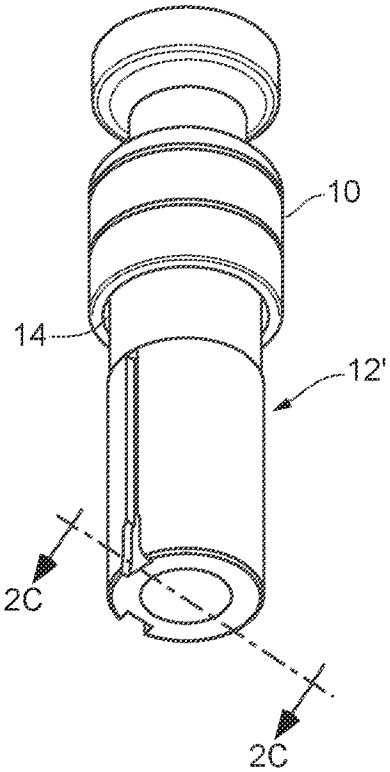
Figure 2A:
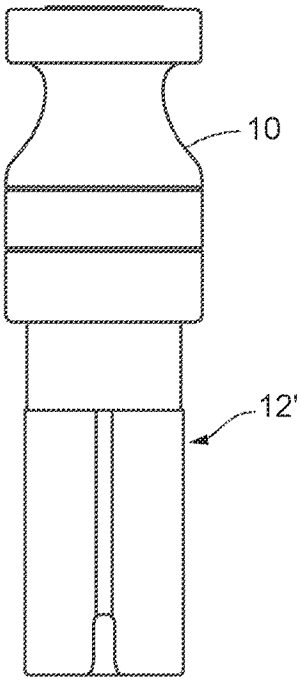
Figure 3B:
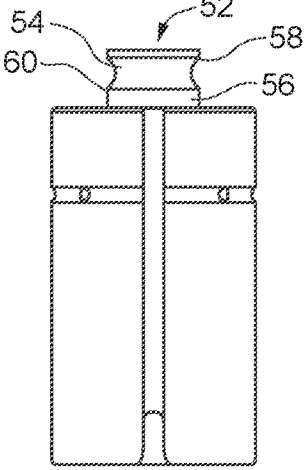
FIGS. 3A, 3B, 3C, and 3D are opposing elevation, perspective, and top views, respectively, of a further punch in accordance with certain embodiments of the invention.
Figure 3D:
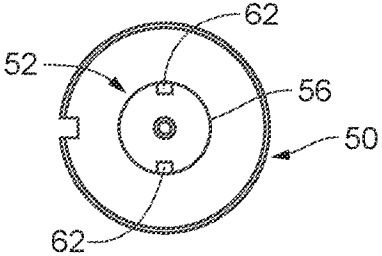
Figure 3A:
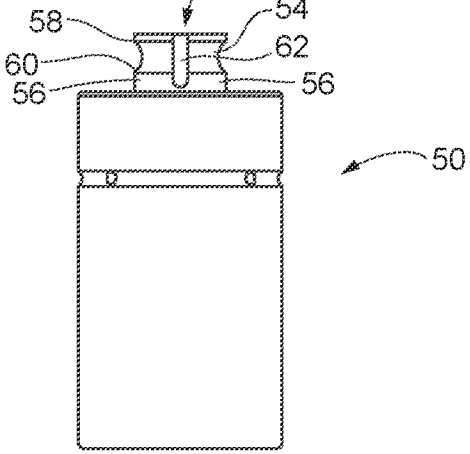
Figure 3C:
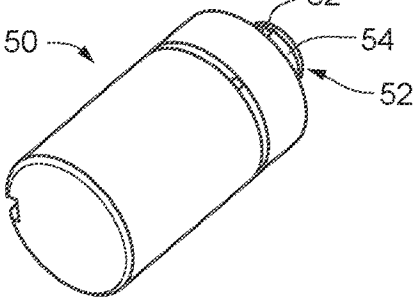

FIGS. 2A, 2B, and 2C, as already described herein, show differing views of the punch holder 10 and an alternate version of the punch 12 further relating to certain embodiments of the invention, with FIG. 2C showing a cross-sectional view of FIG. 2B along the lines 2C-2C. Given the above, it should be appreciated that the same securing/locking steps already described with regard to the holder 10 and punch 12 of FIGS. 1A-1C are equally applicable with the punch holder 10 and alternate punch 12' of FIGS. 2A-2C. However, as noted above, the punch 12' differs in its configuration from the punch 12. In particular, the punch 12', as opposed to being a solid integral body such as punch 12, is shown with an exemplary tip 40 having ejector portion 41 and filler (e.g., urethane) 42 that are configured to mate and in part be secured to coupling end 22' of the punch 12'. To that end, in certain embodiments, the punch 12' is configured to utilize other tips (e.g., having differing footprints) as desired, by readily removing/replacing the tip 40.

The designs of FIGS. 1A-1C and 2A-2C have many favorable aspects. For example, the punches 12, 12' can be removed from the punch holder 10 using only a couple of relatively simple steps, i.e., backing out the fastener 24 from inner threading 32 of the punch 12, 12', and then backing out the punch 12, 12' from the inner threading 16 of the holder 10. To that end, once unlocked, the punches 12, 12' can be backed out from the holder 10 by hand (i.e., without tools).

In addition, a variety of punch configurations can be used with the holder 10 (such as punches 12, 12') so long as the punches have coupling ends of similar design to those of punches 12, 12' (so as to be configurable to the holder 10). Further, the minimal use of components in the design enables its cost to be kept at a low level.

However, the designs of FIGS. 1A-1C and 2A-2C also can be viewed as having a few drawbacks. For example, the steps in adjusting/removing the punch 12, 12' with regard to the holder 10 dictate significant handling of the holder assembly, which can add to the time needed for punch adjustment/replacement, but generally tends to make such processes messy for the user. In addition, the removal/replacement steps generally dictate using a tool (e.g., during the locking/unlocking of the fastener 24 from the punch 12, 12'), adding further time to the process of punch adjustment/replacement. Also, there is repetitive contact made over significant areas of the holder 10, and punch 12, 12' during removal/adjustment of the punch 12, 12', which can promote undesired wear in those areas. Further, while the length of the punch 12, 12' protruding from the holder 12 can be adjusted (following unlocking of the fastener 24 from the punch 12, 12' and then rotation of the punch 12, 12'), it can be difficult to quickly and accurately adjust or fine tune the length as needed. Thus, while the punch holder assemblies of FIGS. 1A-1C and 2A-2C can be viewed as good design options for some, it would be nice to have other similarly-styled, yet advanced, tool holder assembly options for others.

FIGS. 3A-3D, as described above, illustrate differing views of a punch 50 in accordance with certain embodiments. Similar to the punches 12, 12' shown in FIGS. 1A-1C and 2A-2C, the punch 50 has a stem 52 included on a coupling end 54 thereof. However, instead of threading being used for coupling with a punch holder, the punch 50 is defined with a recess 54. As shown, the recess 54 is defined on the lateral surfaces 56 of the stem 52. In certain embodiments, the recess 54 is defined to be of particular shape so as to conjointly mate with shape of locking members of a punch holder (as later described herein). As should be appreciated, the manner by which the shapes of the recess 54 and locking members conjoin, and conversely separate from each other, allow for increased ease and speed by which the punch 50 can be joined to, or removed from, a punch holder. As shown, in certain embodiments, the recess 54 can have a concave shape so as to mate with a spherical member. As further shown, in certain embodiments, the recess 54 can be formed to continuously extend over a circumference of outer side of the stem 52. While it is appreciated that the recess 54 can be defined as other shapes, it should be understood that using a concave shape not only enables easier entry of locking members, but when formed to have defined upper and lower edges 58, 60, vertical movement of spherical members (which are extended into the recess 54) can be minimized.

In certain embodiments as shown, the stem 52 is further defined with slots 62. The slots 62 are configured to mate with guiding members of a punch holder (as later described herein) in order to fix the orientation of the punch 50 with the holder. However, a further benefit of such slots 62 is that they help better position areas of the recess 54 configured to align with locking members of the punch holder. To that end, while not shown, the recess 54 can just as well be defined as a plurality of recesses, located at areas about the stem 52 that are configured to align with locking members of a punch holder. Further, it should be noted that while certain designs may involve inclusion of a solitary slot, the use of multiple slots 62, particularly on opposing sides 56 of the stem 52, effectively minimizes any freedom for the punch 50 to "wiggle" relative to the punch holder.

Continuing with the punch 50, and particularly the stem 52 thereof, in certain embodiments, its outer lateral surfaces 56 are round, whereby such collective surface 56 is circularly shaped; however, the invention should not be limited to such. Instead, the shape of the stem can be formed to have one or more straight edges, while not adversely affecting the parameters of the recess 54 defined therein, as described above. Further, it should be noted that the punch 50 has lower portion similar in design to the punch 12 of FIGS. 1A-1C. In light of this, it should be appreciated that the punch 50, as exemplified via the punch 12' of FIGS. 2A-2C, can take on different footprints as desired so as have wide applicability of use in corresponding punch holders. Two such punch holders 70 and 100 are shown in FIGS. 4A-4E and 7A-7E, respectively, as described below.

Figures 4A, 4B, 4C, 4D, 4E:
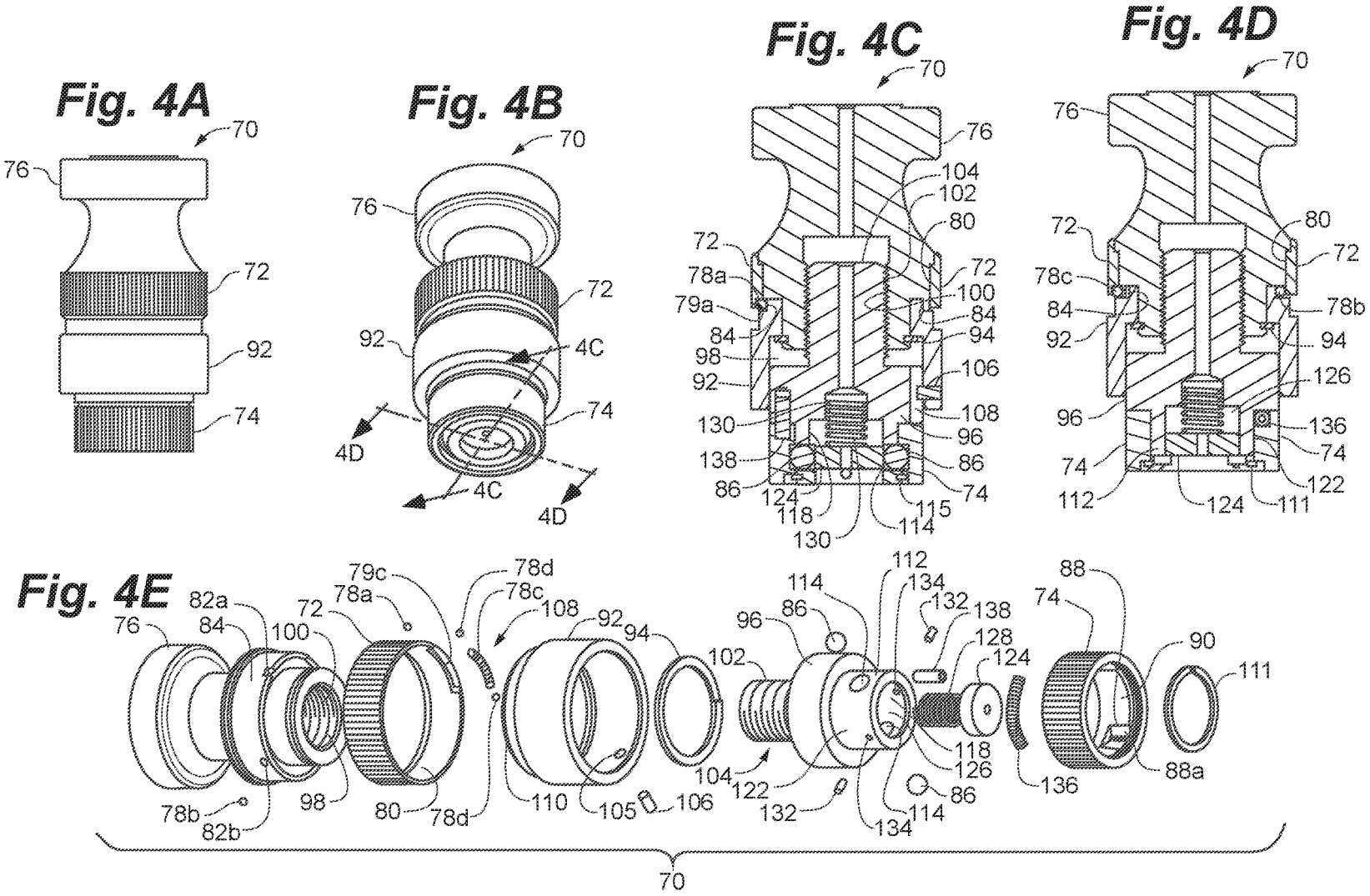
FIGS. 4A, 4B, 4C, 4D, and 4E are elevation, perspective, opposing cross-sectional, and exploded views, respectively, of an additional punch holder in accordance with certain embodiments of the invention.

FIGS. 4A-4E, as described above, show differing views of a punch holder 70 in accordance with certain embodiments of the invention, with FIGS. 4C and 4D showing cross-sectional views of FIG. 4B along lines 4C-4C and 4D-4D, respectively. As illustrated in FIGS. 4A and 4B, the punch holder 70 is configured with upper and lower (or first and second) collars 72, 74 operatively situated on differing segments areas of the holder 70. Each of the collars 72, 74 is adapted to perform different actions with regard to a punch held by the holder 70. Regarding the upper collar 72, when rotated either in clockwise direction or counterclockwise direction, a corresponding height adjustment of a punch (held by the holder 70) results, as described below. Regarding the lower collar 74, it is rotatable in only one direction (e.g., in a counterclockwise direction); however, when rotated, release of a punch (held by the holder 70) results.

Referring back to the upper collar 72, the collar 72 is operably coupled to an upper portion (or head or head unit) 76 of the punch holder 70 such that rotation of the collar 72 results in corresponding rotation of the head 76. In certain embodiments (and as further described below with regard to FIGS. 4E, 5D, and 6D), a flange 84 of the head 76 is operably coupled yet rotatable with the collar 72 via one or more members 78 retained there between. As will be further detailed below, rotation of the head 76 of the punch holder 70 (via rotation of the upper collar 72) results in a corresponding height adjustment of punch held by the holder 70. Conversely, regarding the lower collar 74, as it is rotated relative to a lower portion (or holder coupler or punch coupling unit) 96 of the holder 70, the collar 74 correspondingly enables retaining members 86 to be drawn away from a punch held by the holder 70 so as to release the punch.

As alluded to above, more will be described of the adjustment and release mechanisms of the punch holder 70 below with regard to FIGS. 5A-5G and 6A-6D. However, at this point, it should be appreciated that by using the upper and lower collars 72 and 74, both punch height adjustment and punch removal with regard to the punch holder 70 are made quick and easy actions for the user. For example, punch height adjustment can be provided by the user via a single step or action of rotating the collar 72. Additionally, such punch height adjustment can be performed via a rotating force being applied to the collar 72, wherein application of the rotating force is performable with a single hand of the user. To that end, such adjustment can be performed without need for any tools. Likewise, via use of the lower collar 74, a punch can be released from the punch holder 70 by the user via a single step or action of rotating the collar 74. Additionally, such punch release can also be performed via a rotating force applied with a single free hand of the user. To that end, such release can be performed without need for any tools.

Figures 5A, 5B, 5C, 5D, 5E, 5F, 5G:
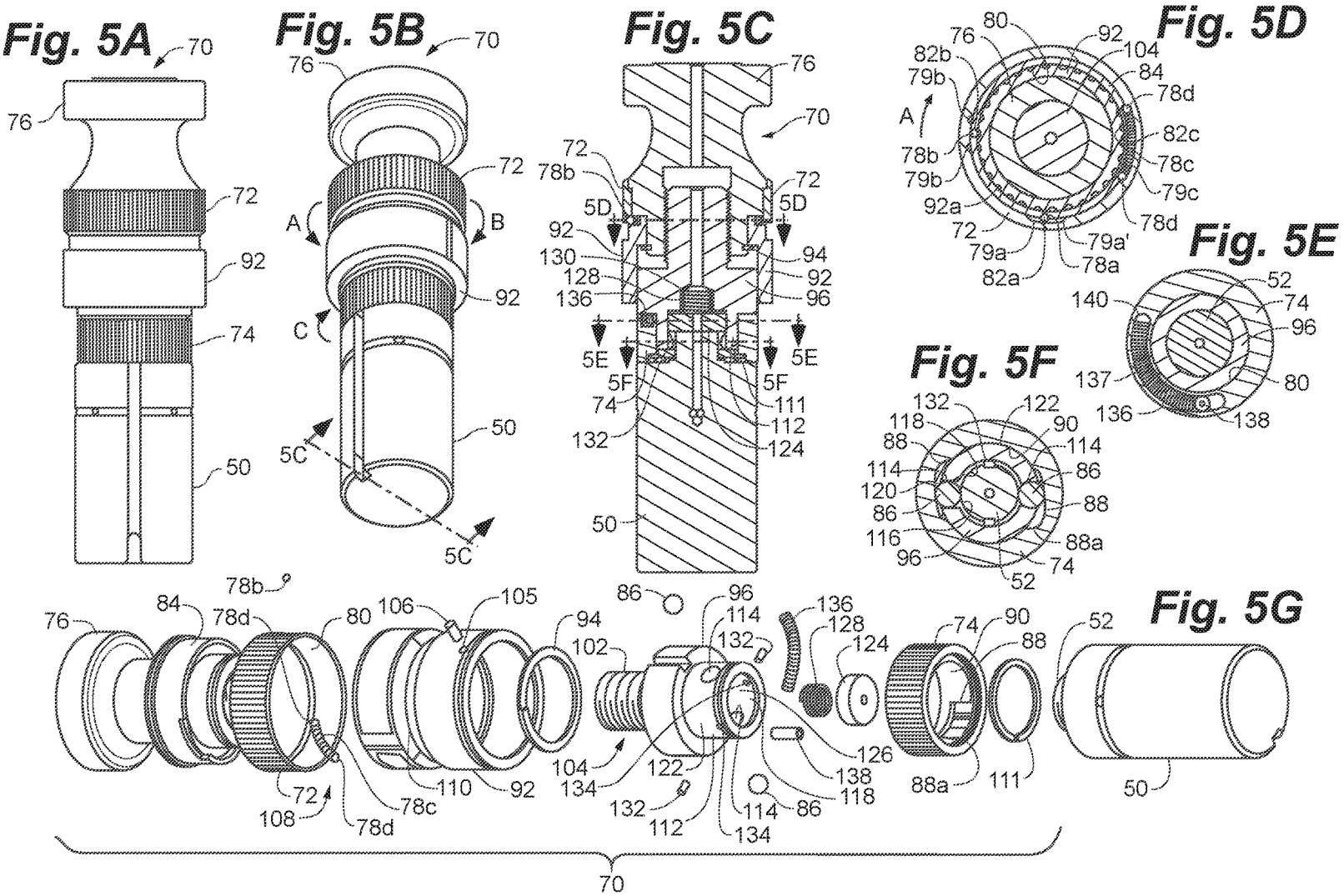
FIGS. 5A, 5B, 5C, 5D, 5E, 5F, and 5G are elevation, perspective, four differing cross-sectional, and exploded views, respectively, of the additional punch holder of FIGS. 4A-4E with the further punch of FIGS. 3A-3D.

Turning to FIGS. 5A-5G, as described above, they illustrate differing views of the punch 50 when retained in the punch holder 70 in accordance with certain embodiments of the invention, with FIG. 5C showing cross-sectional view of FIG. 5B along lines 5C-5C and FIGS. 5D, 5E, and 5F showing cross-sectional views of FIG. 5C along lines 5D-5D, 5E-5E, and 5F-5F, respectively. As described above, with rotation of the upper collar 72, the head 76 of the punch holder 70 can correspondingly rotate on account of its flange 84 being operably coupled with the collar 72 via one or more members 78. With reference to FIG. 5D, in certain embodiments, the one or more members 78 involve a linking member 78*a*. Referring back to FIGS. 4C and 4E and now with reference to FIGS. 5D and 6D, it can be described how the linking member 78*a* is associated with the corresponding rotation of the upper collar 72 and the punch holder head 76, and how the rotation of the head 76 corresponds to vertical height adjustment of the punch 50. However, index collar 92 of the punch holder 70 should initially be detailed.

As shown, e.g., in FIG. 4B, the index collar 92 is situated between the upper and lower collars 72, 74. With reference to FIG. 4C, the index collar 92 is operably held to the punch holder head 76. In certain embodiments as shown, the collar 92 is held to the head 76 via retaining ring 94 (e.g., threaded on the lower end of head 76). However, despite being held together via ring 94, the punch holder head 76 can be rotated relative to the index collar 92. Thus, a function of the ring 94 (apart from joining index collar 92 to punch holder head 76) is to lock or maintain the vertical height of the punch holder head 76 relative to the index collar 92 regardless of rotation of the head 76.

With further reference to FIG. 4C, rotation of the head 76 (via rotation of the upper collar 72) causes height adjustment of a lower segment of the tool holder 70. In certain embodiments, such lower segment is a one-piece element that is shiftably coupled to the head 76 and which the punch 50 is attached (releasably in this embodiment). In certain embodiments, such element is a holder coupler 96, which is coupled to head 76 in similar fashion as punch holder 10 and punches 12, 12' described with regard to FIGS. 1A-1C and 2A-2C. For example, with continued reference to FIG. 4C, a lower end of the punch holder head 76 defines a recess 98 in which the holder coupler 96 is configured to be inserted and secured. In particular, as illustrated in FIG. 4C, the recess 98 of the head 76 has inner threading 100 configured to mate with outer threading 102 of a stem 104 protruding from the holder coupler 96. In use, the holder coupler 96 is inserted in the recess 98 of the head 76 such that the stem 104 is brought into contact with, and screwed into, the threading 100 of the recess 98.

Given the threaded connection between punch holder head 76 and holder coupler 96, rotation of the head 76 would normally involve a corresponding rotation of holder coupler 96. However, with continued reference to FIG. 4C, the index collar 92 defines a bore 105 to support a body 106 (e.g., a dowel pin) which extends into a channel 108 vertically extending along a side of the coupler 96, thereby preventing rotation of the holder coupler 96. As such, with the holder coupler 96 unable to rotate with the punch holder head 76, any rotation of the head 76 causes the head threading 100 to rotate about the coupler threading 102. However, as described above, the retaining ring 94 maintains vertical position of the head 76 relative to the index collar 92. As such, rotation of the head 76 causes vertical adjustment of the holder coupler 96 in the holder threading 100 and corresponding vertical adjustment of punch (e.g., punch 50) held by the coupler 96.

In certain embodiments, with reference to FIG. 5B, rotating the upper collar 72 in a clockwise direction (in the direction of arrow A) results in a corresponding rotation of punch holder head 76 such that holder coupler 96 climbs upward in the threading 100 of head 76 and thereby decreases vertical height of the punch 50. Conversely, rotating the upper collar 72 in a counterclockwise direction (in the direction of arrow B) results in a corresponding rotation of head 76 such that holder coupler 96 backs downward in the threading 100 of head 76 and thereby increase vertical height of the punch 50.

As described above, the head 76 of the punch holder 70 is configured to correspondingly rotate with upper collar 72, and this can be accomplished via use of a linking member 78*a*. As further described, the linking member 78*a* can be retained between the collar 72 and a flange 84 of the head 76. For example, in certain embodiments as shown in FIG. 5D, the linking member 78*a* can be partially retained both within an opening 82*a* in the flange 84 of the head 76 and a recess 79*a* on underside surface 80 of the upper collar 72. As such, if the upper collar 72 is rotated clockwise (in the direction per arrow A), the linking member 78*a* is also rotated so as to rotate the flange 84 of the head 76. In certain embodiments, the recess 79*a* is elongated so as to form more of a channel which is configured to slide about linking member 78*a* during initial rotation of the collar 72, whether turned clockwise or counterclockwise. More will be described of this later.

With continued reference to FIG. 5D, as the head flange 84 is rotated, it passes about an upper end 110 of the index collar 92. In certain embodiments, the upper end 110 is defined with a plurality of notches 92*a* spaced uniformly about a circumference of the end 110, and which forms a means for differentiating degree of vertical height adjustment made to the punch 50. In certain embodiments and as shown with reference to FIGS. 4E and 5D, an indexing member 78*b* is partially retained within a further opening 82*b* of the flange 84. With continued reference to FIG. 5D, in certain embodiments (and contrary to the linking member 78*a*), the indexing member 78*b* is not always held between collar underside surface 80 and flange 84, but only during periods when height of punch 50 is adjusted. To that end, and with reference to FIGS. 5D and 6D, a pair of recesses 79*b* in the underside surface 80 of the upper collar 72 is shown flanking the flange opening 82*b*, and the flange opening 82*b* is in alignment with a particular notch 92*a* of notch collar upper end 110 such that the indexing member is partially retained both in flange opening 82*b* and notch 92*a*. As such, it should be appreciated that FIG. 5D shows a configuration for the punch holder 70 in which the punch 50 is locked at a particular vertical height setting.

Moreover, it should be appreciated the rationale to elongate the upper collar recess 79*a* for linking member 78*a*. For example, and with continued reference to FIG. 5D, if the upper collar 72 is rotated in the direction of A (i.e., in clockwise direction), the recess 79*a* (in underside 80 of upper collar 72) slides in clockwise direction about the linking member 78*a* until the member 78*a* contacts a shoulder 79*a*' of the recess 79*a*. Upon such contact, the linking member 78*a* is forced to rotate with the upper collar 72, which correspondingly rotates punch holder head 76 (based on the member 78*a* being partially retained in flange opening 82*a* of head 76). The extent of the recess 78*a* is defined so that at about the same time the linking member 78*a* contacts the recess shoulder 79*a*', the recess 79*b* previously lagging the indexing member 78*b* is brought into alignment behind the member 78*b*. As such, with the rotation of the flange 84 resulting from the linking member 78*a*, the indexing member 78*b* (on account of also being retained in opening 82*b* of holder flange 84) is forced to back out of its current notch 92*a* in index collar 92 (and partially into aligned recess 79*b*). In turn, as the upper collar 72 is rotated, the indexing member 78*b* rolls about the circumference of the index collar 92, sliding into each notch 92*a* along the way, until the desired further notch setting is reached.

It should be appreciated that the manner by which the indexing member 78*b* slides into each notch 92*a* of the index collar 92 while being rotated, enables the assembly to provide a certain signal with every index setting that the member 78*b* passes. In certain embodiments, such signal may be auditory, such as a clicking sound from the member 78*b* landing into each notch 92*a*. Alternately, or in combination, such signal may be based on touch, e.g., force vibration caused by the member 78*b* landing in each notch 92*a* as the upper collar 72 is turned. Such signaling has particular significance as it can be used by the user to determine to what extent the vertical height of the punch is being adjusted. For example, in certain embodiments, each signal can signify a punch height adjustment of +/−0.002" from the prior index setting. However, it should be appreciated that the division of height adjustment can be configured as desired.

Upon adjusting the indexing member 78*b* to a new desired setting (or notch 92*a*) in the index collar 92, the upper collar 72 can be released. In certain embodiments, with further reference to FIG. 5D, a biasing member 108 is further utilized in recess 79*c* in underside surface 80 of upper collar 72 and opening 82*c* in underside surface of a head flange 84. In certain embodiments as shown, the biasing member 108 can involve at least a spring element 78*c*, and optionally a pair of members 78*d* holding the spring element 78*c* there between. As the upper collar 72 is rotated in either clockwise or counterclockwise directions, the spring element 78*c* is compressed initially between opposing ends recess 79*c* and opening 82*c* from initial non-movement of the flange 84 (as described above with regard to linking member 78*a*). To that end, once the rotating force is removed from the collar 72, the spring element 78*c* recoils, pulling back upper collar 72 in direction opposite the rotation direction such that the recesses 79*b* also recoil in position to flank the indexing member 78*b* (thereby locking the member 78*b* in selected notch 92*a* of index collar 92) and to centrally position the pushing member 78*a* in recess 79*a*. In certain embodiments, one or more of the linking member 78*a*, indexing member 78*b*, and holding members 78*d* are spherical members (e.g., such as ball bearings); however, these members can take on other shapes so long as they can cleanly move along underside surface 80 of upper collar 72 and notched end 110 of index collar 92.

Turning to the lower collar 74, reference is made to FIGS. 5B, 5C, and 5E-5G. As already described above, when the collar 74 is rotated as intended, the collar 74 correspondingly enables retaining members 86 to be drawn away from the punch 50 held by the punch holder 70 so as to release the punch 50. In certain embodiments, the intended rotation is in a counterclockwise direction, e.g., as shown by arrow C in FIG. 5B. However, the invention should not be limited to such, as the intended rotation for the collar 74 could just as well be in a clockwise direction. In certain embodiments, the retaining members 86 are spherical members (e.g., such as ball bearings); however, these members 86 can take on other shapes so long as they can cleanly move within bores 114 and align with cavities 88 and recess contour in punch hub 52. As shown with reference to FIG. 5C, the lower collar 74 is operably held to lower portion (holder coupler) 96 of the punch holder 70. In certain embodiments as shown, the collar 74 is held to the coupler 96 via retaining ring 111 (e.g., threaded on the lower end of coupler 96). However, despite being held together via ring 111, the lower collar 74 can be rotated relative to the holder coupler 96.

The holder coupler 96 and its general functioning with respect to the head 76 of punch holder 70 have already been described. However, with regard to the punch 50 and the retaining members 86 used therefor, a hub 112 of the holder coupler 96 is defined with bores 114 on opposing surfaces thereof. The lower collar 74, when held together to the holder coupler hub 112, encircles hub 112 so as to align with bores 114 thereof. Continuing with the lower collar 74 and its release functionality, reference is made to FIGS. 4C and 5F. In certain embodiments, the bores 114 are defined to have a diameter 116 at inner surface 118 of the hub 112 that is greater than a diameter 120 at the hub outer surface 122. As such, the retaining members 86 are permitted to protrude from, yet not pass through the bores 114 at the hub inner surface 118. Conversely, in certain embodiments, the retaining members 86 are permitted to pass out of the bores 114 at the hub outer surface 122 and be kept in continual contact with cavities 88 defined in underside surface 90 of lower collar 74. As such, the members 86 are at least partially retained in bores 114, even at deepest areas of cavities 88.

In certain embodiments, moving the collar 74 in its rotatable direction results in cavities 88 defined in underside surface 90 of the collar 74 to corresponding rotate and increase in depth under retaining members 86 such that the members 86 lose contact with, and thereby release, the punch 50. In certain embodiments, floor surface 88*a* of the cavities 88 in underside surface 80 is defined to be smooth and gradually ramp with regard to its depth transition in order to enable smooth travel of the members 86 along such surfaces 88*a* as the lower collar 74 is rotated. Consequently, corresponding rotation of the collar 74 is made to be smooth, i.e., not impeded by any sudden changes in depth along cavities 88.

It should be appreciated that once the lower collar 74 is rotated, and the depth of cavities 88 increase behind the retaining members 86, a downward pulling force applied to the punch 50 could be used to force the members 86 to withdraw into the cavities 88 and thereby release the punch 50. However, certain embodiments involve using means to force the retaining members 86 to withdraw into cavities 88 and to force the punch 50 out from the holder coupler 96 upon rotation of the lower collar 74. In certain embodiments, a spring-loaded plunger 124 is provided as such means. As further detailed below, travel path of the plunger 124 is confined to the hub inner recess 126 of the holder coupler 96.

Starting at a state at which punch 50 is already secured to punch holder 70 (see FIG. 5C), the hub 52 of the punch 50 is located within inner recess 126 of holder coupling hub 112. With further reference to FIG. 5F, the retaining members 86 are shown in contact with corresponding shallow regions of cavities 88 so as to protrude from the bores 114 and be conjoined with recess 54 of the punch hub 52. In this state, it should also be noted that a spring 128 is in compressed state to the rear of the plunger 124. In certain embodiments, the spring 128 is housed within a pocket 130 located atop hub inner recess 126.

With reference to FIGS. 4B, 4C and 5F, upon rotation of the lower collar 74, the depth of cavities 88 increases behind the retaining members 86, and the plunger 124 travels to its fully-extended position (via recoiling force of spring 128), thereby pushing against punch hub 52 (forcing its exit from hub inner recess 126) and further pushing out any portions of retaining members 86 projecting from bores 114 into hub recess 126. As described above, the travel path of the plunger 124 is confined to the hub inner recess 126, whereby the plunger 124 is prevented from extending outside the inner recess 126 via contact with one or more pins 132 (see FIG. 4D). In certain embodiments as shown, two such pins 132 may be used, with the pins 132 protruding from corresponding holes 134 provided on opposing sides of hub inner surface 118 (e.g., directly opposite the inner surface sides of the hub 112 in which the bores 114 are defined). It should be recognized that the pins 132, when positioned in such manner, would further correspond to slots 62 in hub 52 of punch 50 to ensure correct positioning of the punch 50 with the holder 70.

In certain embodiments, a protection mechanism is provided to prevent the punch 50 from being inadvertently released from the holder 70. With reference to FIG. 5E, following release of rotational force on the lower collar 74, the mechanism forces the collar 74 back to its pre-rotation position. Much like the biasing member 108 described with regard to the upper collar 72, a biasing member 136 (e.g., spring) can be used as the mechanism, but in this case, it is located within channel 137 of collar 74. Further distinguishing from the biasing member 108 described with regard to the upper collar 72, the biasing member is operably coupled to a pin (e.g., dowel pin) 138 vertically extending between holder coupler 96 and upper collar 72 (see FIG. 4C). With reference to FIG. 5E, as the lower collar 74 is rotated in applicable direction, the channel 137 corresponding slides about the biasing member 136 and compresses member between channel end 140 and rigidly-fixed pin 138. To that end, once the rotating force is removed from the collar 74, the biasing member 136 is configured to recoil against channel end 140, thereby rotating lower collar 74 to its pre-rotated position.

Continuing with the above, the recoil of the biasing member 136 would correspondingly cause lower collar 74 to return to its pre-rotated position, i.e., such that shallow-depth regions of cavities 88 are aligned with retaining members 86, thereby driving the members 86 (via contact with floor region 88*a* of cavities 88) to project again out of bores 114 and into hub recess 126. However, as described above, a prior effect of the rotating force being applied to the collar 74 is the plunger 124, via spring 128, sliding to a position within the hub recess 126 so as to come into contact with the pins 132. In certain embodiments, the plunger 124 in this extended (or release) position is aligned with the bores 114 of the recess 126. As a consequence, the retaining members 86 can be blocked from protruding from the bores 114 of the recess 126. Thus, despite the recoiling force of biasing member 136 as described above, the retaining members 86 are prevented from moving axially, and as such, the lower collar 74 can be effectively locked in its rotated state.

Such state, and blocking position of the plunger 124 relative to the bores 114 and retaining members 86, in turn enhances ease by which a new punch 50 can be inserted into recess 126 and subsequently locked therein (via retaining members 86). To that end, such insertion/locking of punch 50 with the holder 70 can be performed without corresponding rotation of the lower collar 74, but instead with application of a single vertical force applied to the punch 50 as it is inserted into the recess 126. For example, in subsequently coupling a further punch 50 to the holder 70, the hub 52 of such punch 50 can be inserted in the inner hub recess 126 and forced against plunger 124 until the plunger 124 is vertically pushed out of alignment with the bores 114. Once such clearance is established in the recess 126 at the bores 114, the recoiling force of the biasing member 136 causes the lower collar 74 to rotate to its pre-rotated position. This rotation of the collar 74 thereby slides the shallow-depth regions of cavities 88 into alignment with retaining members 86, driving the members 86 (via contact with floor region 88*a* of cavities 88) to project out of bores 114 and into hub recess 126, thereby locking punch 50 via the members 86. As described above, once locked to the holder 70, the punch 50 is prevented from being released without corresponding rotation of the lower collar 74, and the collar 74 is predisposed to be in a non-rotated position via the biasing member 136 being in its recoiled (or expanded state).

Figures 6A, 6B, 6C, 6D:
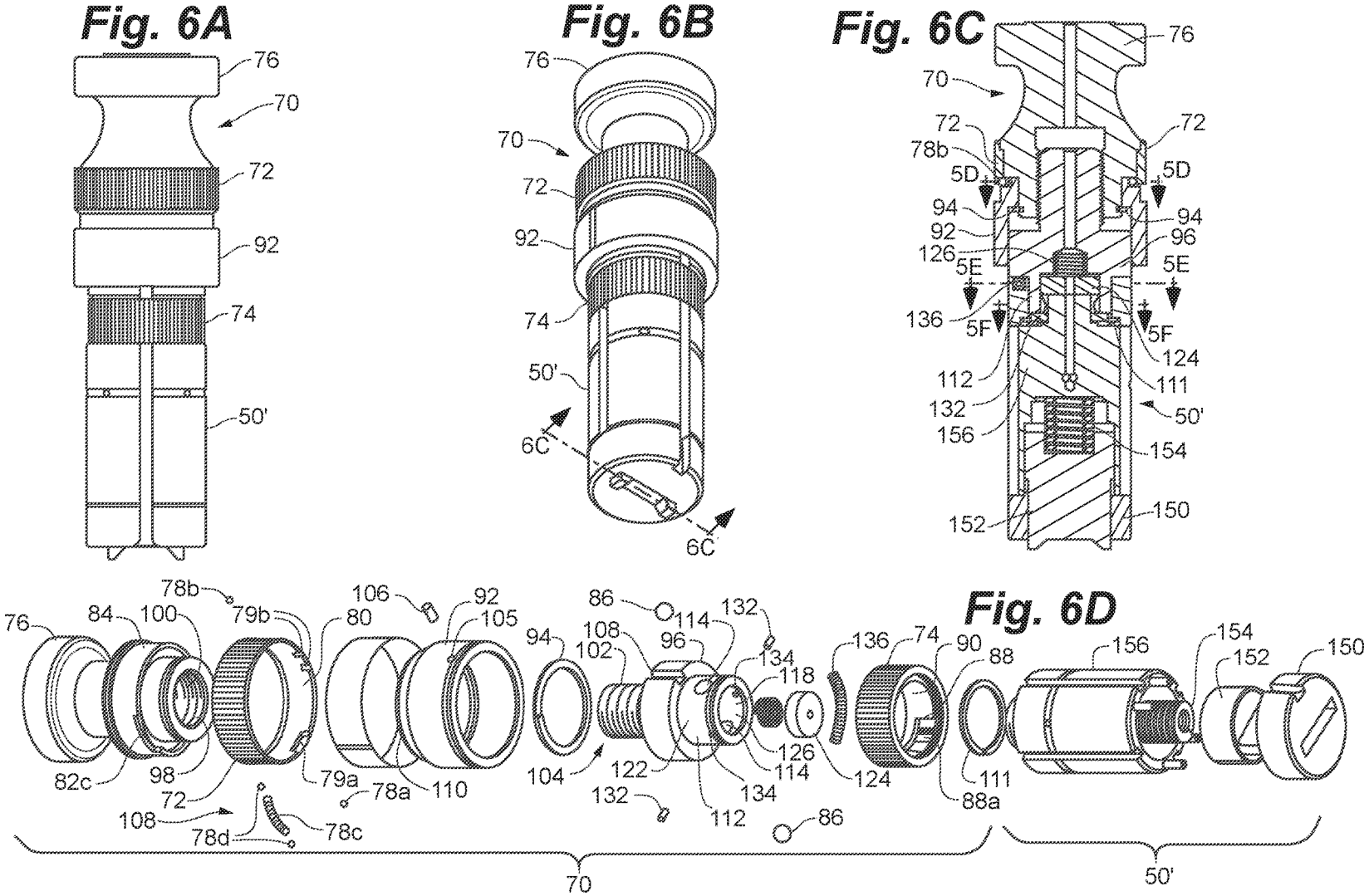
FIGS. 6A, 6B, 6C, and 6D are elevation, perspective, lateral cross-sectional, and exploded views, respectively, of the additional punch holder of FIGS. 4A-4E with alternate version of the further punch of FIGS. 3A-3D in accordance with certain embodiments of the invention.

Turning to FIGS. 6A-6D, as described above, they illustrate differing views of an alternate version of the punch 50 when retained in the punch holder 70 in accordance with certain embodiments of the invention, with FIG. 6C showing cross-sectional view of FIG. 6B along lines 6C-6C. Given the above, it should be appreciated that the same punch adjustment/release steps already described with regard to the holder 70 and punch 50 of FIGS. 5A-5G are equally applicable with the punch holder 70 and alternate punch 50' of FIGS. 6A-6D. However, as noted above, the punch 50' differs in its configuration from the punch 50. In particular, the punch 50', as opposed to being a solid integral body such as punch 50, is shown with an exemplary tip 150 having ejector portions 152 and mechanism for ejecting (e.g., spring 154) that are configured to mate with and in part be secured to coupling portion 156 of the punch 50'. To that end, in certain embodiments, the punch 50' is configured to utilize other tips as desired, by readily removing/replacing the tip 150.

Figures 7A, 7B, 7C, 7D, 7E:
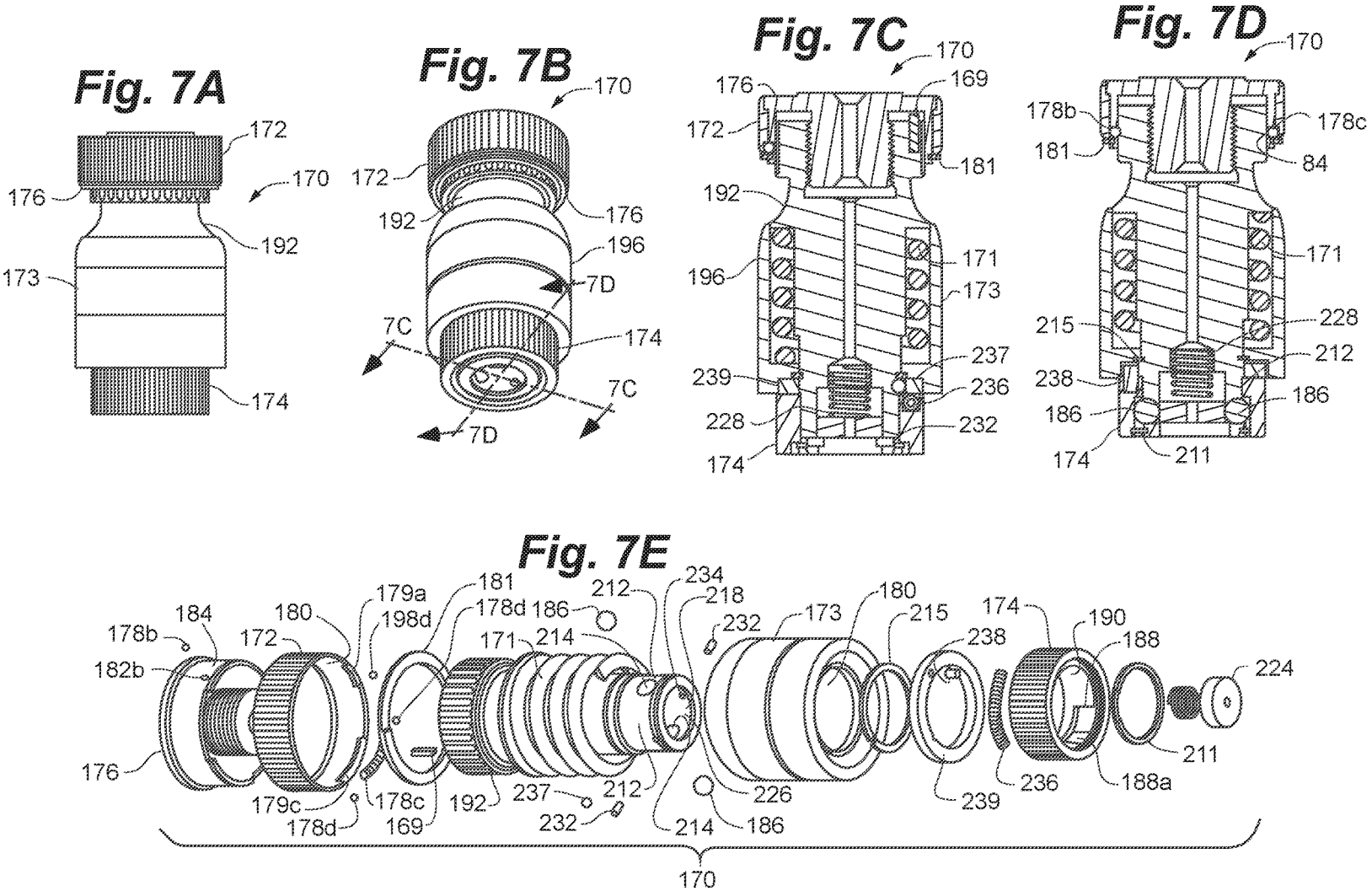
FIGS. 7A, 7B, 7C, 7D, and 7E are elevation, perspective, opposing lateral cross-sectional, and exploded views, respectively, of a further punch holder in accordance with certain embodiments of the invention.

FIGS. 7A-7E, as described above, show differing views of an additional punch holder 170 in accordance with certain embodiments of the invention, with FIGS. 7C and 7D showing cross-sectional views of FIG. 7B along lines 7C-7C and 7D-7D, respectively. As illustrated in FIGS. 7A and 7B, the punch holder 170 is configured with upper and lower (or first and second) collars 172, 174 operatively situated on differing segments areas of the holder 170. Each of the collars 172, 174 is adapted to perform different actions with regard to a punch held by the holder 170. Regarding the upper collar 172, when rotated either in clockwise direction or counterclockwise direction, a corresponding height adjustment of a head 176 of the holder 170 results, as described below. Regarding the lower collar 174, it is rotatable in only one direction (e.g., in a counterclockwise direction); however, when rotated, release of a punch (held by the holder 170) results.

Comparing the punch holder 170 of FIGS. 7A-7E with the punch holder 70 of FIGS. 4A-4E, the punch holder 170 has some significant differences in structure, but a certain amount of crossover is carried over from what has been already been disclosed with regard to the height adjustment and release mechanisms configured with the punch holder 70. For example, the punch holder 170 has a different configuration, with a spring 171 being positioned internal to a flange collar or flange 173, such that the holder 170 is correspondingly thought of, and thus referred to, as a "floating" configuration. In light of this, as described above, the upper collar 172 shown for punch holder 170 can be situated at the head 176 whereby the height of the head 176 is adjustable. However, when combined with floating functionality of head (via spring 171), the head 176 can be driven an added distance so as to at least match (and often exceed) adjusted height that can be achieved with punch holder 70 (with respect to directly adjusting height of punch mounted to the holder). As for lower collar 174, the description for its function of releasing punch is very similar to what was described for punch holder 70, but differs in terms of not having a holder coupler. As such, the lower collar is instead held to a lower end of the index collar 192.

Referring back to the upper collar 172, the collar 172 is operably coupled to an upper portion (or head or head unit) 176 of the punch holder 170 such that rotation of the collar 172 results in corresponding height adjustment of the head relative to an index collar 192. In certain embodiments (and as further described below with regard to FIGS. 7E, 8D, and 9D), a flange 184 of the head 176 is operably coupled to the collar 172 via a retaining ring 181 and the head 176 is rotatable with the collar 172 via one or more members retained between. As will be further detailed below, rotation of the head 176 (via rotation of the upper collar 172) results in a corresponding height adjustment of the head 176. Conversely, regarding the lower collar 174, as it is rotated relative to a lower portion (or index collar or punch coupling unit) 192 of the holder 170, the collar 174 correspondingly enables retaining members 186 to be drawn away from a punch held by the holder 170 so as to release the punch.

As alluded to above, more will be described of the adjustment and release mechanisms of the punch holder 170 below with regard to FIGS. 8A-8H and 9A-9D. However, at this point, it should be appreciated that by using the upper and lower collars 172 and 174, both head height adjustment and punch removal with regard to the punch holder 170 are made quick and easy actions for the user. For example, head height adjustment can be provided by the user via a single step or action of rotating the collar 172. Additionally, such head height adjustment can be performed via a rotating force being applied to the collar 172, wherein application of the rotating force is performable with a single hand of the user. To that end, such adjustment can be performed without need for any tools. Likewise, via use of the lower collar 174, a punch can be released from the punch holder 170 by the user via a single step or action of rotating the collar 174. Additionally, such punch release can also be performed via a rotating force applied with a single free hand of the user. To that end, such release can be performed without need for any tools.

Figures 8A, 8B, 8C, 8D, 8E, 8F, 8G, 8H:
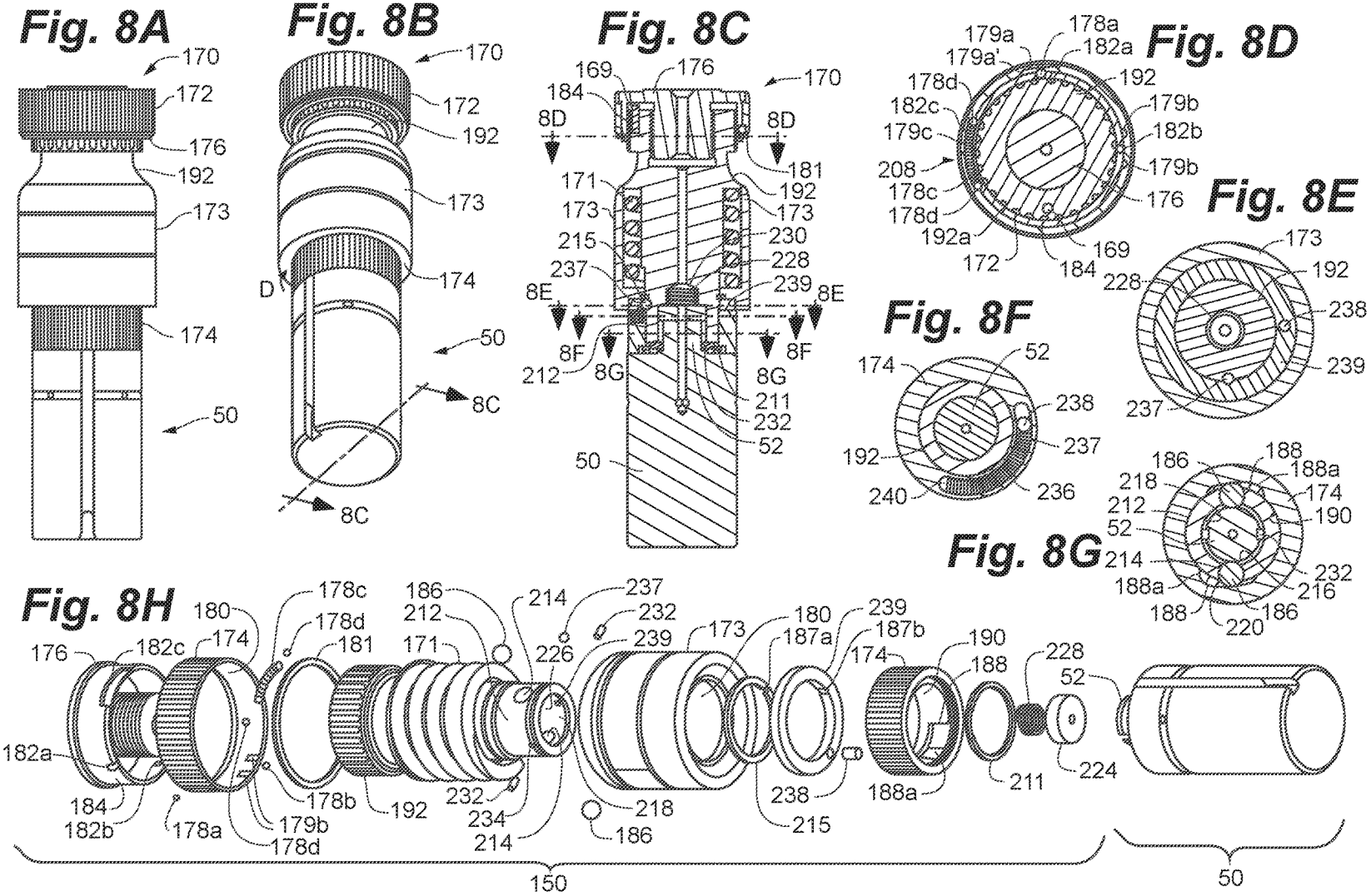
FIGS. 8A, 8B, 8C, 8D, 8E, 8F, 8G, and 8H are elevation, perspective, lateral cross-sectional, four differing axial cross-sectional, and exploded views, respectively, of the further punch holder of FIGS. 7A-7E with the further punch of FIGS. 3A-3D.

Turning to FIGS. 8A-8H, as described above, they illustrate differing views of the punch 50 when retained in the punch holder 170 in accordance with certain embodiments of the invention, with FIG. 8C showing cross-sectional view of FIG. 8B along lines 8C-8C and FIGS. 8D, 8E, 8F, and 8G showing cross-sectional views of FIG. 8C along lines 8D-8D, 8E-8E, 8F-8F, and 8G-8G, respectively. As described above, with rotation of the upper collar 172, the head 176 of the punch holder 70 can correspondingly rotate on account of its flange 184 being operably coupled with the collar 172 with one or more members retained there between. With reference to FIG. 8D, in certain embodiments, the one or more members involve a linking member 178*a*. Referring back to FIGS. 7C and 7E and now with reference to FIGS. 8D and 9D, it can be described how the linking member 178*a* is associated with the corresponding rotation of the upper collar 172 and the head 176, and how the rotation of the head 176 corresponds to effective vertical height adjustment of the punch 50.

As described above, the head 176 of the punch holder 170 has operably coupled thereto the upper collar 172, and this can be accomplished via use of a linking member 178*a*. As further described, the linking member 178*a* can be retained between the collar 172 and a flange 184 of the head 176. For example, in certain embodiments as shown in FIG. 8D, the linking member 178*a* can be partially retained both within an opening 182*a* in the flange 184 of the head 176 and a recess 179*a* on underside surface 180 of the upper collar 172. As such, if the upper collar 172 is rotated clockwise (in the direction per arrow A), the linking member 178*a* is also rotated so as to rotate the flange 184 of the head 176. In certain embodiments, the recess 179*a* is elongated so as to form more of a channel which is configured to slide about linking member 178*a* during initial rotation of the collar 172, whether turned clockwise or counterclockwise. More will be described of this later.

With continued reference to FIG. 8D, as the head flange 184 is rotated, it passes about an upper end 210 of an index collar 192. In certain embodiments as shown, a spacing body (e.g., formed of urethane) 169 protrudes vertically from index collar upper end 210 to prevent too low of an adjustment with regard to head 176. In certain embodiments, the upper end 210 is defined with a plurality of notches 192*a* spaced uniformly about a circumference of the end 210, and which forms a means for differentiating degree of vertical height adjustment made to the head 176. In certain embodiments and as shown with reference to FIGS. 7E and 8D, an indexing member 178*b* is partially retained within a further opening 182*b* of the flange 184. With continued reference to FIG. 8D, in certain embodiments (and contrary to the linking member 178*a*), the indexing member 178*b* is not always held between collar underside surface 180 and flange 184, but only during periods when height of head 176 is adjusted. To that end, and with reference to FIGS. 8D and 9D, a pair of recesses 179*b* in the underside surface 180 of the upper collar 172 is shown flanking the flange opening 182*b*, and the flange opening 182*b* is in alignment with a particular notch 192*a* of notch collar upper end 210 such that the indexing member is partially retained both in flange opening 182*b* and notch 192*a*. As such, it should be appreciated that FIG. 8D shows a configuration for the punch holder 170 in which the punch 50 is locked at a particular vertical height setting.

Moreover, it should be appreciated the rationale to elongate the upper collar recess 179*a* for linking member 178*a*. For example, and with continued reference to FIG. 8D, if the upper collar 172 is rotated in the direction of A (i.e., in clockwise direction), the recess 179*a* (in underside 180 of upper collar 172) slides in clockwise direction about the linking member 178*a* until the member 178*a* contacts a shoulder 179*a*' of the recess 179*a*. Upon such contact, the linking member 178*a* is forced to rotate with the upper collar 172, which correspondingly rotates extension head 176 (based on the member 178*a* being partially retained in flange opening 182*a* of extension head 176). The extent of the recess 178*a* is defined so that at about the same time the linking member 178*a* contacts the recess shoulder 179*a*', the recess 179*b* previously lagging the indexing member 178*b* is brought into alignment behind the member 178*b*. As such, with the rotation of the flange 184 resulting from the linking member 178*a*, the indexing member 178*b* (on account of also being retained in opening 182*b* of holder flange 184) is forced to back out of its current notch 192*a* in index collar 192 (and partially into aligned recess 179*b*). In turn, as the upper collar 172 is rotated, the indexing member 178*b* rolls about the circumference of the index collar 192, sliding into each notch 192*a* along the way, until the desired further notch setting is reached.

It should be appreciated that the manner by which the indexing member 178*b* slides into each notch 192*a* of the index collar 192 while being rotated, enables the assembly to provide a certain signal with every index setting that the member 178*b* passes. In certain embodiments, such signal may be auditory, such as a clicking sound from the member 178*b* landing into each notch 192*a*. Alternately, or in combination, such signal may be based on touch, e.g., force vibration caused by the member 178*b* landing in each notch 192*a* as the upper collar 172 is turned. Such signaling has particular significance as it can be used by the user to determine to what extent the vertical height of the punch is being adjusted. For example, in certain embodiments, each signal can signify a punch height adjustment of +/−0.002" from the prior index setting. However, it should be appreciated that the division of height adjustment can be configured as desired.

Upon adjusting the indexing member 178*b* to a new desired setting (or notch 192*a*) in the index collar 192, the upper collar 172 can be released. In certain embodiments, with further reference to FIG. 8D, a biasing member 208 is further utilized in recess 179*c* in underside surface 180 of upper collar 172 and opening 182*c* in underside surface of head flange 184. In certain embodiments as shown, the biasing member 208 can involve at least a spring element 178*c*, and optionally a pair of members 178*d* holding the spring element 178*c* there between. As the upper collar 172 is rotated in either clockwise or counterclockwise directions, the spring element 178*c* is compressed initially between opposing ends recess 179*c* and opening 182*c* from initial non-movement of the flange 184 (as described above with regard to linking member 178*a*). To that end, once the rotating force is removed from the collar 172, the spring element 178*c* recoils, pulling back upper collar 172 in direction opposite the rotation direction such that the recesses 179*b* also recoil in position to flank the indexing member 178*b* (thereby locking the member 178*b* in selected notch 192*a* of index collar 192) and to centrally position the pushing member 178*a* in recess 179*a*. In certain embodiments, one or more of the linking member 178*a*, indexing member 178*b*, and holding members 178*d* are spherical members (e.g., such as ball bearings); however, these members can take on other shapes so long as they can cleanly move along underside surface 180 of upper collar 172 and notched end 210 of index collar 192.

Turning to the lower collar 174, reference is made to FIGS. 8B, 8C, and 8E-8H. As already described above, when the collar 174 is rotated as intended, the collar 174 correspondingly enables retaining members 186 to be drawn away from the punch 50 held by the punch holder 170 so as to release the punch 50. In certain embodiments, the intended rotation is in a counterclockwise direction, e.g., as shown by arrow D in FIG. 8B. However, the invention should not be limited to such, as the intended rotation for the collar 174 could just as well be in a clockwise direction. In certain embodiments, the retaining members 186 are spherical members (e.g., such as ball bearings); however, these members 186 can take on other shapes so long as they can cleanly move within bores 214 and align with cavities 188 (as described below) and recess contour in punch hub 52. As shown with reference to FIG. 8C, the lower collar 174 is operably held to lower portion (index collar) 192 of the punch holder 170. In certain embodiments as shown, the lower collar 174 is held to the index collar 192 via retaining ring 211 (e.g., threaded on the lower end of index collar 192). However, despite being held together via ring 211, the lower collar 174 can be rotated relative to the index collar 192. It should be further noted (with reference to FIG. 8C) that lower end of index collar passes through opening 180 in floating flange 173 and floating flange 173 is held to index collar 192. In certain embodiments as shown, the floating flange 173 is held to the index collar 192 via retaining ring 215 (e.g., threaded on lower end segment of index collar 192).

The index collar 192 and its general functioning with respect to adjustable head 176 of punch holder 170 have already been described. However, with regard to the punch 50 and the retaining members 186 used therefor, a hub 212 of the index collar 192 is defined with bores 214 on opposing surfaces thereof. The lower collar 174, when held together to the index collar hub 212, encircles the hub 212 so as to align with bores 214 thereof. Continuing with the lower collar 174 and its release functionality, reference is made to FIGS. 7C and 8G. In certain embodiments, the bores 214 are defined to have a diameter 216 at inner surface 218 of the hub 212 that is greater than a diameter 220 at the hub outer surface 222. As such, the retaining members 186 are permitted to protrude from, yet not pass through the bores 214 at the hub inner surface 218. Conversely, in certain embodiments, the retaining members 186 are permitted to pass out of the bores 214 at the hub outer surface 222 and be kept in continual contact with cavities 188 defined in underside surface 190 of lower collar 174. As such, the members 186 are at least partially retained in bores 214, even at deepest areas of cavities 188.

In certain embodiments, moving the collar 174 in its rotatable direction results in cavities 188 defined in underside surface 190 of the collar 174 to corresponding rotate and increase in depth under retaining members 186 such that the members 186 lose contact with, and thereby release, the punch 50. In certain embodiments, floor surface 188*a* of the cavities 188 in underside surface 180 is defined to be smooth and gradually ramp with regard to its depth transition in order to enable smooth travel of the members 186 along such surfaces 188*a* as the lower collar 174 is rotated. Consequently, corresponding rotation of the collar 174 is made to be smooth, i.e., not impeded by any sudden changes in depth along cavities 188.

It should be appreciated that once the lower collar 174 is rotated, and the depth of cavities 188 increase behind the retaining members 186, a downward pulling force applied to the punch 50 could be used to force the members 186 to withdraw into the cavities 188 and thereby release the punch 50. However, certain embodiments involve using means to force the retaining members 86 to withdraw into cavities 188 and to force the punch 50 out from the index collar 192 upon rotation of the lower collar 174. In certain embodiments, a spring-loaded plunger 224 is provided as such means. As further detailed below, travel path of the plunger 224 is confined to the hub inner recess 226 of the index collar 192.

Starting at a state at which punch 50 is already secured to punch holder 170 (see FIG. 7C), the hub 52 of the punch 50 is located within inner recess 226 of index collar hub 212. With further reference to FIG. 8G, the retaining members 186 are shown in contact with corresponding shallow regions of cavities 188 so as to protrude from the bores 214 and be conjoined with recess 54 of the punch hub 52. In this state, it should also be noted that a spring 228 is in compressed state to the rear of the plunger 224. In certain embodiments, the spring 228 is housed within a pocket 230 located atop hub inner recess 226.

With reference to FIGS. 7B, 7C and 8G, upon rotation of the lower collar 174, the depth of cavities 188 increases behind the retaining members 186, and the plunger 224 travels to its fully-extended position (via recoiling force of spring 228), thereby pushing against punch hub 52 (forcing its exit from hub inner recess 226) and further pushing out any portions of retaining members 186 projecting from bores 214 into hub recess 226. As described above, the travel path of the plunger 224 is confined to the hub inner recess 226, whereby the plunger 224 is prevented from extending outside the inner recess 226 via contact with one or more pins 232 (see FIG. 7C). In certain embodiments as shown, two such pins 232 may be used, with the pins 232 protruding from corresponding holes 234 provided on opposing sides of hub inner surface 218 (e.g., directly opposite the inner surface sides of the hub 212 in which the bores 214 are defined). It should be recognized that the pins 232, when positioned in such manner, would further correspond to slots 62 in hub 52 of punch 50 to ensure correct positioning of the punch 50 with the holder 170.

In certain embodiments, a protection mechanism is provided to prevent the punch 50 from being inadvertently released from the holder 170. With reference to FIG. 8F, following release of rotational force on the lower collar 174, the mechanism forces the collar 174 back to its pre-rotation position. Much like the biasing member 208 described with regard to the upper collar 172, a biasing member 236 (e.g., spring) can be used as the mechanism, but in this case, it is located within channel 237 of collar 174. Further distinguishing from the biasing member 208 described with regard to the upper collar 172, the biasing member is operably coupled to a pin 238 vertically extending from stop ring 239 held between retaining ring 215 and lower collar 174 and prevented from rotating via member (e.g., ball) 237, partially retained in recesses 187*a* and 187*b* of ring 215 and stop ring 239, respectively (see FIGS. 8C, 8E, and 8F). With reference to FIG. 8F, as the lower collar 174 is rotated in applicable direction, the channel 237 corresponding slides about the biasing member 236 and compresses member between channel end 240 and rigidly-fixed pin 238. To that end, once the rotating force is removed from the collar 174, the biasing member 236 is configured to recoil against channel end 240, thereby rotating lower collar 174 to its pre-rotated position.

Continuing with the above, the recoil of the biasing member 236 would correspondingly cause lower collar 174 to return to its pre-rotated position, i.e., such that shallow-depth regions of cavities 188 are aligned with retaining members 186, thereby driving the members 186 (via contact with floor region 188*a* of cavities 188) to project again out of bores 214 and into hub recess 226. However, as described above, a prior effect of the rotating force being applied to the collar 174 is the plunger 224, via spring 228, sliding to a position within the hub recess 226 so as to come into contact with the pins 232. In certain embodiments, the plunger 224 in this extended (or release) position is aligned with the bores 214 of the recess 226. As a consequence, the retaining members 186 can be blocked from protruding from the bores 214 of the recess 226. Thus, despite the recoiling force of biasing member 236 as described above, the retaining members 186 are prevented from moving axially, and as such, the lower collar 174 can be effectively locked in its rotated state.

Such state, and blocking position of the plunger 224 relative to the bores 214 and retaining members 86, in turn enhances ease by which a new punch 50 can be inserted into recess 226 and subsequently locked therein (via retaining members 186). To that end, such insertion/locking of punch 50 with the holder 170 can be performed without corresponding rotation of the lower collar 174, but instead with application of a single vertical force applied to the punch 50 as it is inserted into the recess 226. For example, in subsequently coupling a further punch 50 to the holder 170, the hub 52 of such punch 50 can be inserted in the inner hub recess 226 and forced against plunger 224 until the plunger 224 is vertically pushed out of alignment with the bores 214. Once such clearance is established in the recess 226 at the bores 214, the recoiling force of the biasing member 236 causes the lower collar 174 to rotate to its pre-rotated position. This rotation of the collar 174 thereby slides the shallow-depth regions of cavities 188 into alignment with retaining members 186, driving the members 186 (via contact with floor region 188*a* of cavities 188) to project out of bores 214 and into hub recess 226, thereby locking punch 50 via the members 186. As described above, once locked to the holder 170, the punch 50 is prevented from being released without corresponding rotation of the lower collar 174, and the collar 174 is predisposed to be in a non-rotated position via the biasing member 236 being in its recoiled (or expanded state).

Figures 9A, 9B, 9C, 9D:
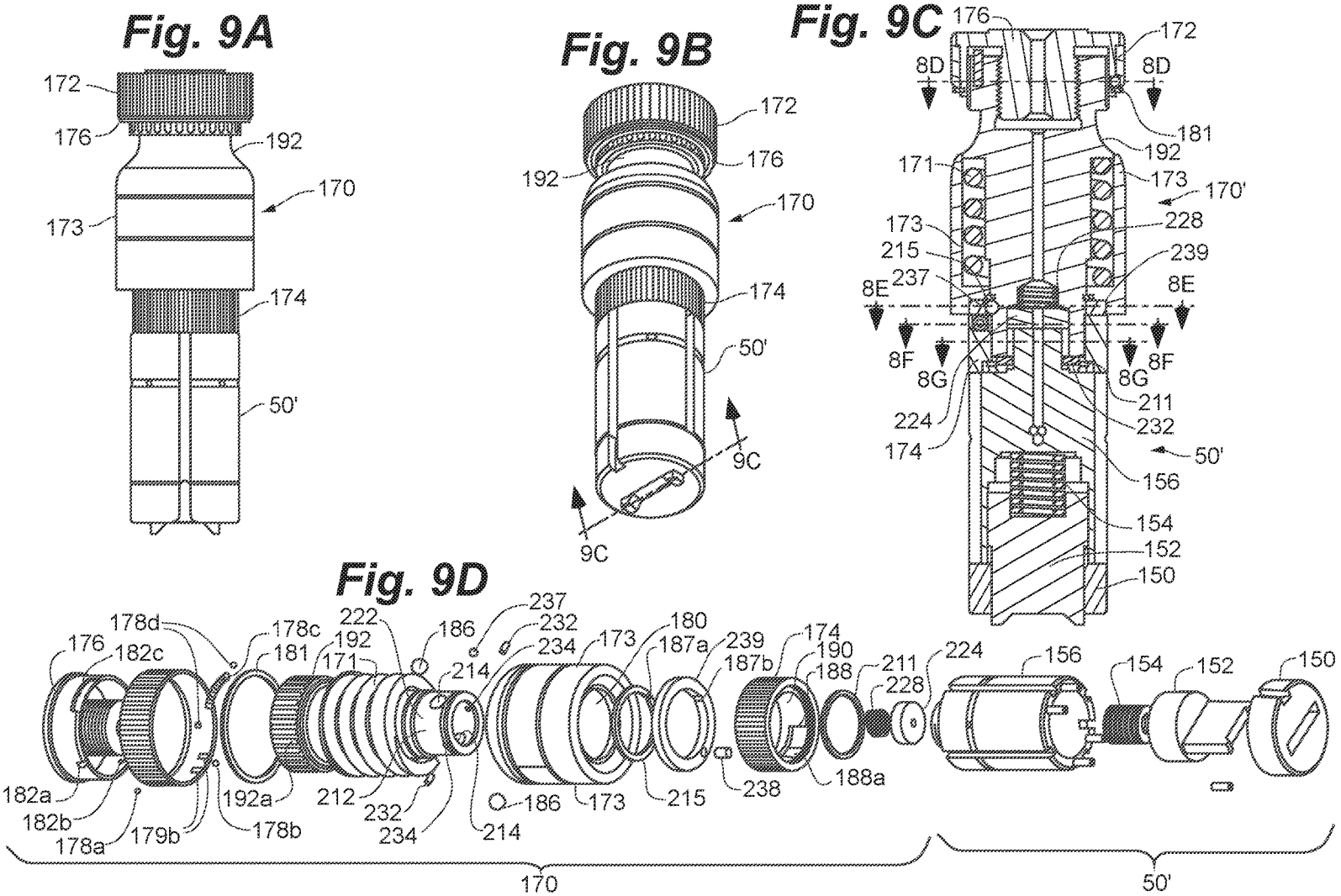
FIGS. 9A, 9B, 9C, and 9D are elevation, perspective, lateral cross-sectional, and exploded views, respectively, of the further punch holder of FIGS. 7A-7E with the alternate version of further punch of FIGS. 3A-3D in accordance with certain embodiments of the invention.

Turning to FIGS. 9A-9D, as described above, they illustrate differing views of an alternate version of the punch 50 when retained in the punch holder 170 in accordance with certain embodiments of the invention, with FIG. 9C showing cross-sectional view of FIG. 9B along lines 9C-9C. Given the above, it should be appreciated that the same punch adjustment/release steps already described with regard to the holder 170 and punch 50 of FIGS. 8A-8H are equally applicable with the punch holder 170 and alternate punch 50' of FIGS. 9A-9D. However, as noted above, the punch 50' differs in its configuration from the punch 50. In particular, the punch 50', as opposed to being a solid integral body such as punch 50, is shown with an exemplary tip 150 having ejector portions 152 and mechanism for ejecting (e.g., spring 154) that are configured to mate with and in part be secured to coupling portion 156 of the punch 50'. To that end, in certain embodiments, the punch 50' is configured to utilize other tips as desired, by readily removing/replacing the tip 150.

Figure 10:
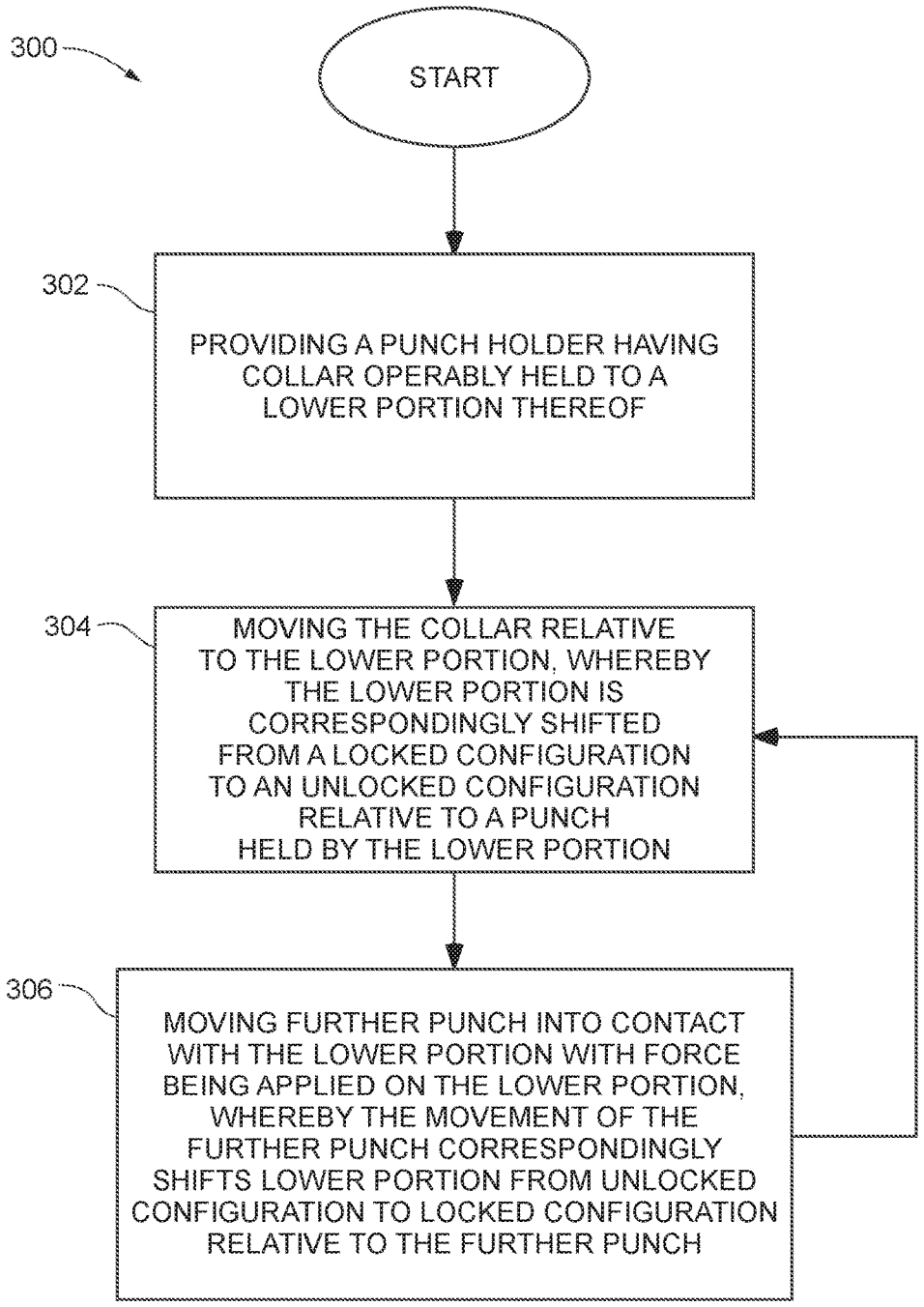
FIG. 10 is a flow diagram of method of releasing and replacing a punch within certain punch holders in accordance with certain embodiments of the invention.

FIG. 10 shows a flow diagram 300 of method of releasing and replacing a punch within punch holders 70, 170 in accordance with certain embodiments of the invention. For example, with reference back to FIGS. 5A-5G, the punch holder 70 is provided with an upper portion (head or head unit) 76 and a lower portion (holder coupler) 96, wherein the head 76 is operably coupled to the lower portion 96. The lower collar 74 encircles a lateral extent (e.g., hub 112) of the lower portion 96, and the collar 72 is movable in position relative to the portion 96. Thus, with reference to the punch holder 70, an initial step 302 of the flow diagram includes providing punch holder having collar 74 operably held to a lower portion 96 thereof. A subsequent step 304 of the flow diagram includes moving the collar 74 relative to the lower portion 96, whereby the lower portion 96 is correspondingly shifted from a locked configuration to an unlocked configuration relative to a punch 50 held by the lower portion 96. Thus, following step 304, the punch 50 is released from the punch holder 70. A further step 306 of the flow diagram includes moving a further punch (e.g., 50') into contact with the lower portion 96 (plunger 124) of the punch holder 70 with force being applied on the lower portion 96, whereby movement of the further punch correspondingly shifts lower portion 96 from unlocked configuration to locked configuration relative to the further punch. As shown, following step 306, the diagram loops back to step 304 with regard to further punch replacement on the holder 70.

As described above, the flow diagram of FIG. 10 also corresponds to releasing and replacing a punch within punch holder 170. For example, with reference back to FIGS. 8A-8H, the punch holder 170 is provided with an upper portion (head or head unit) 176 and a lower portion (index collar) 192, wherein the head 176 is operably coupled to the lower portion 192. The lower collar 174 encircles a lateral extent (e.g., hub 212) of the lower portion 192, and the collar 72 is movable in position relative to the portion 192. Thus, with reference to the punch holder 170, the initial step 302 of the flow diagram includes providing punch holder having collar 174 operably held to a lower portion 192 thereof. The subsequent step 304 of the flow diagram includes moving the collar 174 relative to the lower portion 192, whereby the lower portion 192 is correspondingly shifted from a locked configuration to an unlocked configuration relative to a punch 50 held by the lower portion 192. Thus, following step 304, the punch 50 is released from the punch holder 170. A further step 306 of the flow diagram includes moving a further punch (e.g., 50') into contact with the lower portion 192 (plunger 224) of the punch holder 170 with force being applied on the lower portion 192, whereby movement of the further punch correspondingly shifts lower portion 192 from unlocked configuration to locked configuration relative to the further punch. Again, following step 306, the diagram loops back to step 304 with regard to further punch replacement on the holder 170.

Figure 11B:
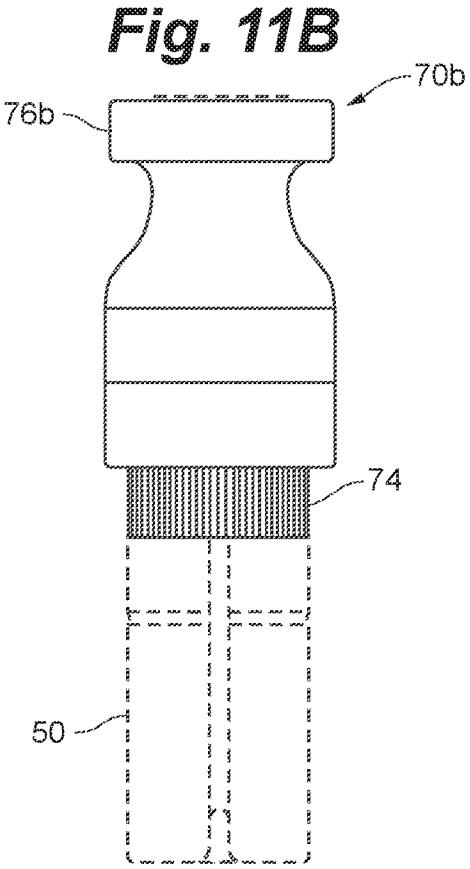
FIGS. 11A and 11B are elevation views of alternate punch holders of the punch holder of FIGS. 4A-4E in accordance with certain embodiments of the invention, with an exemplary punch also shown (in dashed lines) being held by each holder.
Figure 11A:
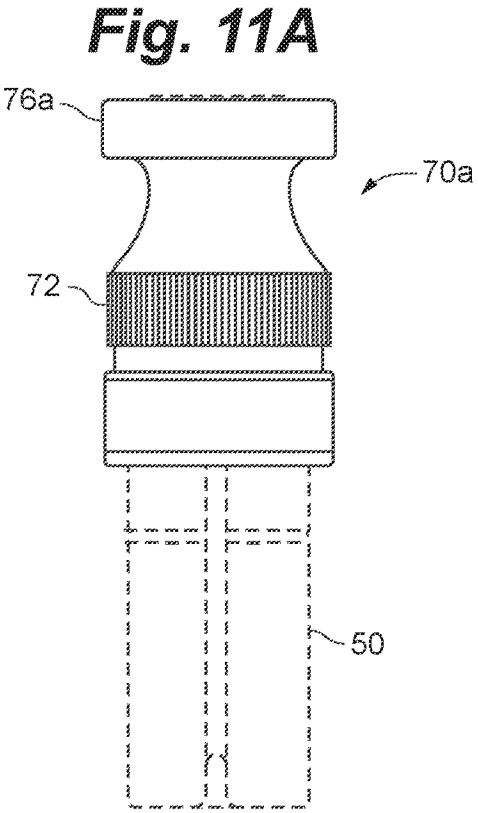

While not shown, it would be understood from FIGS. 4A-4E, 5A-5G, and 6A-6D and the corresponding description that alternative punch holders could be configured with only one of the upper collar 72 or lower collar 74. For example, a punch holder could be configured with upper collar 72 and use other punch release mechanisms, whether needing tools or not, to remove the punch from the punch holder. FIGS. 11A and 11B illustrate elevation views of such alternate punch holders 70*a*, 70*b* in accordance with certain embodiments of the invention. As shown, each punch holder 70*a* and 70*b* is shown holding an exemplary punch (shown in dashed lines).

Starting with FIG. 11A, the punch holder 70*a* is configured with only a single collar, i.e., the upper collar 72 as already described herein. Operation of the collar 72 and corresponding vertical adjustment of punch 50 secured by the holder 70*a* is similar to that already described herein; however, in certain embodiments, the holder coupler (visibly hidden under head 76*a* of holder 70*a* in FIG. 11A, but described with reference to FIGS. 4A-4E, 5A-5G, and 6A-6D) is configured to be part of the punch 50 to form a single body. In certain embodiments, the holder coupler is detachable from upper end of punch 50. However, when the coupler is secured to the punch upper end, the punch 50 can be operably coupled/released following steps similar to those already described herein for the punches 12, 12' of FIGS. 1A-1C and 2A-2C, as the punch 50 (via coupler 96*a*) would have a threaded upper end that is configured to mate with threaded recess of the head 76*a* of the holder 70*a*. It should be further understood with reference to FIGS. 5A-5G that such a threaded connection between punch 50 (via coupler 96*a*) and holder 70*a* would further enable the collar's rotation to correspondingly adjust vertical position of the punch 50.

Looking to FIG. 11B, the punch holder 70*b* is likewise configured with only a single collar, i.e., the lower collar 74 as already described herein. Operation of the collar 74 and corresponding release/securement of punch 50 with respect to the head 76*b* of the holder 70*b* is similar to that already described herein; however, in certain embodiments, the head 76*b* of the holder 70*b* can be formed as a single body (from head to lower end), with lower end formed as a hub having features similar to those already described herein for the hub 112 of FIGS. 5A-5G. To that end, it should be understood with reference to FIGS. 5A-5G how rotation of the collar 74 correspondingly serves to release/secure punch 50 with respect to such hub of holder 70*b*.

Figure 12B:
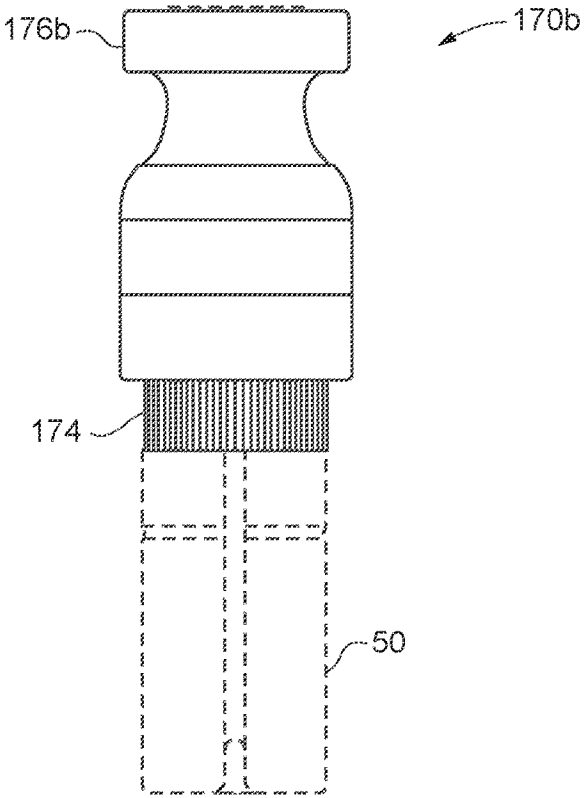
FIGS. 12A and 12B are elevation views of alternate punch holders of the punch holder of FIGS. 7A-7E in accordance with certain embodiments of the invention, with an exemplary punch also shown (in dashed lines) being held by each holder.
Figure 12A:
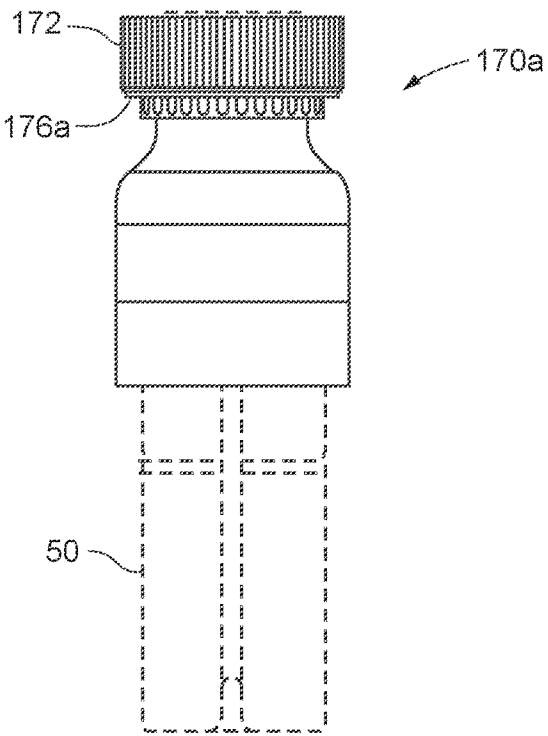

Continuing with the above, it would be understood from FIGS. 7A-7E, 8A-8H, and 9A-9D and the corresponding description that alternate punch holders could just as well be configured with only one of the upper collar 172 or lower collar 174. FIGS. 12A and 12B show elevation views of such alternate punch holders 170*a*, 170*b* in accordance with certain embodiments of the invention. As shown, each punch holder 170*a* and 170*b* is shown holding an exemplary punch (shown in dashed lines).

Starting with FIG. 12A, the punch holder 170*a* is configured with only a single collar, i.e., the upper collar 172 as already described herein. Operation of the collar 172 and corresponding vertical adjustment of head 176*a* is similar to that already described herein; however, in certain embodiments, the punch 50 is threaded within recess of index collar (visibly hidden under head 176*a* of holder 170*a* in FIG. 12A, but described with reference to FIGS. 7A-7E, 8A-8H, and 9A-9D) to form a single body. In certain embodiments, the index collar is detachable from upper end of punch 50. However, when the index collar is secured to the punch upper end, the punch 50 can be operably coupled/released following steps similar to those already described herein for the punches 12, 12' of FIGS. 1A-1C and 2A-2C as the punch 50 would have a threaded upper end that is configured to mate with threaded recess of the index collar. It should be further understood with reference to FIGS. 8A-8H that such a threaded connection between punch 50 and index collar would further enable rotation of the upper collar 172 to correspondingly adjust vertical position of the head 176*a* relative to the index collar and punch 50.

Looking to FIG. 12B, the punch holder 170*b* is likewise configured with only a single collar, i.e., the lower collar 174 as already described herein. Operation of the collar 174 and corresponding release/securement of punch 50 with respect to the head 176*b* of the holder 170*b* is similar to that already described herein; however, in certain embodiments, the head 176*b* of the holder 170*b* can be formed as a single body (from head to lower end), with lower end formed as a hub having features similar to those already described herein for the hub 212 of FIGS. 8A-8H. To that end, it should be understood with reference to FIGS. 8A-8H how rotation of the collar 174 correspondingly serves to release/secure punch 50 with respect to such hub of holder 170*b*.

It should be appreciated that various other punch holder designs could foreseeably fall within the spirit of the invention based on the above-described embodiments. For example, such designs can perhaps involve alternate mechanisms for releasing/securing a punch, e.g., pressing a button and then rotating punch to remove from the punch holder, or by vertically moving tab and then rotating punch to remove from the punch holder. These other designs would relate to the embodiments described herein, e.g., as each includes a rotating step, although the punch (instead of a collar) would be rotated instead in these designs. Furthermore, despite the release/securement mechanism for the punch, the embodied designs described herein for vertical adjustment of the punch (via collar 72 of FIGS. 4A-4E, 5A-5G, and 6A-6D) or holder head (via collar 172 of FIGS. 7A-7E, 8A-8H, and 9A-9D) would also be fully applicable to such designs.

Thus, embodiments of a PUNCH HOLDER AND PUNCH CONFIGURATIONS are disclosed. One skilled in the art will appreciate that the invention can be practiced with embodiments other than those disclosed. The disclosed embodiments are presented for purposes of illustration and not limitation, and the invention is limited only by the claims that follow.

What is claimed is:

1. A punch holder comprising:

an upper portion and a lower portion, the upper portion comprising a head unit and the lower portion comprising a punch coupling unit, the upper portion operably coupled yet selectively adjustable relative to the lower portion;

a first collar encircling an extent of the upper portion, the first collar being movable on the upper portion, whereby movement of the first collar is limited to rotation relative to the upper portion, whereby a rotating force being applied to the first collar results in an adjustment in overall height of the punch holder, the first collar comprising a biasing member situated between the first collar and upper portion, the biasing member configured to rotate the first collar in opposite rotational direction upon the rotating force being released, the rotation of the first collar in the opposite direction resulting in separation of a rotational interlocking apparatus of the first collar and the upper portion; and a second collar encircling an extent of the lower portion, the second collar being movable in position relative to the lower portion, whereby movement of the second collar corresponds to a shift from a locked configuration to an unlocked configuration for the lower portion relative to a punch held thereby.

2. The punch holder of claim 1 wherein the second collar is operably held about a protruding end of the lower portion, the movement of the second collar results from a rotating force solely being applied to the second collar.

3. The punch holder of claim 2 wherein application of the rotating force is performable via twisting of the second collar via a single hand of a user without need of a tool.

4. The punch holder of claim 1 wherein the rotation of the first collar results in corresponding movement of the upper portion.

5. The punch holder of claim 4 wherein the first collar is rotatable via rotating force being applied to the first collar, wherein application of the rotating force is performable via a single hand of a user without need of a tool.

6. The punch holder of claim 5 wherein the first collar is operably coupled to the upper portion at a top of the upper portion.

7. The punch holder of claim 6 wherein rotation of the first collar corresponds to vertical adjustment of the upper portion relative to the lower portion.

8. The punch holder of claim 5 wherein the first collar is operably coupled to the upper portion below a head of the upper portion.

9. The punch holder of claim 8 wherein rotation of the first collar corresponds to vertical adjustment of the lower portion relative to the upper portion.

10. A punch holder comprising:

an upper portion and a lower portion, the upper portion comprising a head unit and the lower portion comprising a punch coupling unit, the upper portion operably coupled yet selectively adjustable relative to the lower portion; and a collar encircling an extent of the upper portion, the collar being movable on the upper portion, whereby rotational movement of the collar is triggered solely from contact with the collar, the contact being a rotating force applied to the collar and resulting in a the rotation of the collar, thereby providing an adjustment in overall height of the punch holder, the collar being operably coupled to the upper portion, wherein movement of the collar results in corresponding movement of the upper portion, the collar comprising a biasing member situated between the collar and upper portion, the biasing member configured to rotate the collar in opposite rotational direction upon the rotating force being released, the rotation of the collar in the opposite direction resulting in separation of a rotational interlocking apparatus of the collar and the upper portion.

11. The punch holder of claim 10 wherein the collar is rotatable via rotating force being applied to the collar, wherein application of the rotating force is performable via a single hand of a user without need of a tool.

12. The punch holder of claim 10 wherein the collar is operably coupled to the upper portion at a head of the upper portion.

13. The punch holder of claim 12 wherein rotation of the collar corresponds to vertical adjustment of the upper portion relative to the lower portion.

14. The punch holder of claim 13 wherein the upper portion comprises a hub having an outer threading, the lower portion comprising a recess having an inner threading, wherein the upper portion is operably coupled yet adjustable in vertical position relative to the lower portion via engagement and adjustment of the outer threading relative to the inner threading.

15. The punch holder of claim 13 wherein the head of the upper portion has a plurality of notches defined in a lateral outer surface of the head, the notches uniformly distributed about a circumference of the lateral outer surface.

16. The punch holder of claim 15 further comprising one or more index members retained between the collar and the head, the one or more index members adapted to travel about the circumference of head lateral outer surface and in and out of the plurality of notches in response to rotation of the collar, wherein travel of the one or more index members between neighboring notches is representative of a corresponding amount of height adjustment of upper portion relative to lower portion.

17. The punch holder of claim 10 wherein the collar is operably coupled to the upper portion below a head of the upper portion.

18. The punch holder of claim 17 wherein rotation of the collar corresponds to vertical adjustment of the lower portion relative to the upper portion.

19. The punch holder of claim 18 wherein the upper portion comprises a recess having inner threading, the lower portion comprising a hub having outer threading, wherein the upper portion is operably coupled to the lower portion via engagement of the hub threading in the recess threading.

20. The punch holder of claim 19 further comprising a coupler body operably held to lower end of upper portion and surrounding an upper extent of the lower portion, the coupler body held to upper portion so as to permit rotation of the upper portion relative to the coupler body yet prevent vertical adjustment of the upper portion relative to the coupler body, the coupler body comprises a key that extends from body into key channel of lower portion such that rotation of the upper portion correspondingly results in lowering or raising of hub of lower portion in recess of upper portion.

21. The punch holder of claim 20 wherein the coupler body of the upper portion has a plurality of notches defined in lateral outer surface of the body, the notches uniformly distributed about a circumference of the lateral outer surface.

22. The punch holder of claim 21 further comprising one or more index members retained between collar and the coupler body, the one or more index members adapted to travel about the circumference of coupler body lateral outer surface and in and out of the plurality of notches in response to rotation of the collar, wherein travel of the index member between neighboring notches is representative of a corresponding amount of height adjustment of lower portion relative to upper portion.

* * * * *